US009683366B2

(12) United States Patent
Gen

(10) Patent No.: US 9,683,366 B2
(45) Date of Patent: Jun. 20, 2017

(54) SOUNDPROOF ROOM

(71) Applicant: DAIWA HOUSE INDUSTRY CO., LTD., Osaka (JP)

(72) Inventor: Haruo Gen, Osaka (JP)

(73) Assignee: DAIWA HOUSE INDUSTRY CO., LTD., Osaka (JP)

( * ) Notice: Subject to any disclaimer, the term of this patent is extended or adjusted under 35 U.S.C. 154(b) by 9 days.

(21) Appl. No.: 14/762,104

(22) PCT Filed: Mar. 13, 2013

(86) PCT No.: PCT/JP2013/056997
§ 371 (c)(1),
(2) Date: Jul. 20, 2015

(87) PCT Pub. No.: WO2014/115340
PCT Pub. Date: Jul. 31, 2014

(65) Prior Publication Data

US 2015/0315783 A1 Nov. 5, 2015

(30) Foreign Application Priority Data

Jan. 24, 2013 (JP) ..... 2013-010722

(51) Int. Cl.
*E04B 1/99* (2006.01)
*E04B 1/82* (2006.01)
*G10K 11/168* (2006.01)

(52) U.S. Cl.
CPC ..... *E04B 1/99* (2013.01); *E04B 1/8209* (2013.01); *G10K 11/168* (2013.01)

(58) Field of Classification Search
CPC ..... E04B 1/99
USPC ..... 52/144
See application file for complete search history.

(56) References Cited

U.S. PATENT DOCUMENTS 7,798,287 B1 * 9/2010 Surace ..... B32B 15/06 181/286
2004/0067710 A1 * 4/2004 Tsujiyama ..... B32B 5/26 442/329
2006/0201741 A1 * 9/2006 Inoue ..... G10K 11/168 181/204

(Continued)

FOREIGN PATENT DOCUMENTS

JP S62-42607 U 3/1987
JP H05280140 A 10/1993

(Continued)

OTHER PUBLICATIONS

International Search Report for corresponding International Application No. PCT/JP2013/056997, mailed Apr. 23, 2013.

*Primary Examiner* — Joshua J Michener
*Assistant Examiner* — Keith Minter
(74) *Attorney, Agent, or Firm* — Hauptman Ham, LLP

(57) ABSTRACT

The soundproof room (41*a*) has an interior space (43*a*) defined by soundproof walls (44*a*, 45*a*, 46*a*, 47*a*). The soundproof room (41*a*) includes a sound absorber (11*a*) whose sound absorbing face absorbs sound in the room and is exposed in the room. The sound absorber (11*a*) has a varying depth dimension from a front face (19*a*), serving as the sound absorbing face, toward the depth direction. The sound absorber (11*a*) is formed by stacking a plurality of layer members from the front face (19*a*), serving as the sound absorbing face, in the depth direction.

20 Claims, 21 Drawing Sheets

(56) References Cited

U.S. PATENT DOCUMENTS

| | | | | |
|---|---|---|---|---|
| 2011/0266088 | A1* | 11/2011 | Koike | B32B 3/12 181/290 |
| 2013/0025965 | A1* | 1/2013 | Miyake | E04F 15/225 181/290 |
| 2015/0075901 | A1* | 3/2015 | Beresowski | E04B 1/86 181/290 |

FOREIGN PATENT DOCUMENTS

| | | | |
|---|---|---|---|
| JP | H11-293804 | A | 10/1999 |
| JP | 2001-003483 | A | 1/2001 |
| JP | 2003090015 | A | 3/2003 |
| JP | 2005266445 | A | 9/2005 |
| JP | 2007286387 | A | 11/2007 |
| JP | 2010-248756 | U | 11/2010 |

* cited by examiner

SOUNDPROOF ROOM

TECHNICAL FIELD

This invention relates to soundproof rooms (hereinafter, they may be sometimes simply referred to as "room"), and particularly relates to a soundproof room with a sound absorbing structure that absorbs sound generated in the soundproof room.

BACKGROUND ART

Conventionally, some sound rooms and audio rooms, which are used for instrument playing, movie appreciation, and other sound-related events, are equipped with a soundproof structure that prevents sound generated inside the room from leaking outside the room, as well as a sound absorbing structure that eliminates standing waves remaining in corners of the room in order to improve acoustics that instrument players and listeners perceive in the room and that absorbs sounds in some audio frequency ranges generated in the room and reflected off on walls of the room in order to enhance the reverberation of the sound in the room. Conventionally used sound absorbing structures in rooms include sound absorbing panels and sound absorbing materials.

Technologies relating to absorption of sound generated in a room are disclosed in Japanese Unexamined Utility Model Application Publication No. 1987(SHO62)-42607 (Patent Literature 1) and Japanese Unexamined Patent Application Publication No. 2007-286387 (Patent Literature 2). According to the sound room disclosed in Patent Literature 1, bass absorbers having a approximately triangular cross section are installed along almost the entire length of joints between walls and the ceiling of a room, two surfaces of each bass absorber fitting along a wall and the ceiling, respectively, and one surface facing obliquely downward to the inside of the room. Patent Literature 1 intends to effectively absorb low-pitched sounds with these bass absorbers. Patent Literature 2 discloses a sound improving member for improving sound in a structure. The sound improving member is installed at the boundary between structure surfaces that compose the structure in two directions or three directions, and includes a positioning section in contact with the structure surfaces and a tilted face that is inclined relative to the structure surfaces in two directions or three directions while the positioning section is in contact with the structure surfaces to effect positioning. The tilted face of the sound improving member reflects or absorbs sound to improve the sound inside the structure.

CITATION LIST

Patent Literature

PTL1: Japanese Unexamined Utility Model Application Publication No. 1987(Sho62)-42607

PTL2: Japanese Unexamined Patent Application Publication No. 2007-286387

SUMMARY OF INVENTION

Technical Problem

However, even the bass absorber disclosed in Patent Literature 1 and the sound improving member disclosed in Patent Literature 2 cannot properly absorb sound in a room, and consequently the people playing instruments sometimes feel annoyed with the sound. This is because Patent Literature 1 absorbs only low-pitched sound, but does not absorb high-pitched sound. In addition, the simple structure of Patent Literature 2 in which the sound improving member has only the tilted face may be sometimes insufficient to absorb sound. In both cases, even if people play instruments in a room, the sound from the instruments does not properly reach the people's ears, and therefore it can be said that both are unsatisfactory sound absorbing structures.

This invention has an object to provide a soundproof room capable of more properly absorbing sound in the room.

Solution to Problem

The soundproof room according to an embodiment of the invention has an interior space defined by soundproof walls. The soundproof room includes a sound absorber whose sound absorbing face absorbs sound in the room and is exposed in the room. The sound absorber has a varying depth dimension as viewed from the sound absorbing face toward a depth direction. The sound absorber is formed by stacking a plurality of layer members from the sound absorbing face in the depth direction.

According to the soundproof room, the sound absorber included in the soundproof room has a varying depth dimension from the sound absorbing face, which absorbs sound, toward a depth direction. When sound enters through the sound absorbing face exposed in the room, the relatively thick part can efficiently absorb sounds with long wavelengths in a low audio frequency range, while both the relatively thick part and the relatively thin part can efficiently absorb sounds with short wavelengths in a high audio frequency range. In short, the sound absorber can efficiently absorb sounds in a broad audio frequency range from high to low. Since this sound absorber is formed by stacking a plurality of layer members from the sound absorbing face in the depth direction, even if layer members arranged on the sound absorbing face side cannot completely absorb sounds and allow the sounds to pass therethrough, the other layer members arranged further than the sound absorbing face in the depth direction can absorb the sounds permeated. Thus, this sound absorber can absorb sound in the room more properly.

In addition, the sound absorber may be configured to include a first segment whose depth dimension from the sound absorbing face is 23 cm or greater, and a second segment whose depth dimension from the sound absorbing face is less than 23 cm. According to the configuration, the first segment can reliably absorb sounds in a low audio frequency range, while both the first and second segments can reliably absorb sounds in a high audio frequency range. Thus, this sound absorber can absorb sound in the room still more properly.

Furthermore, the sound absorber may be configured to include a maximum depth region whose depth dimension from the sound absorbing face is the greatest, and a depth increasing region whose depth dimension increases while approaching to the maximum depth dimension from the sound absorbing face, the depth increasing region being adjacent to the maximum depth region. According to this configuration, the sound absorber can efficiently and continuously absorb sounds across the low audio frequency range to the high audio frequency range.

The sound absorber may be configured to be a approximately triangular prism in shape. According to this configuration, effective use of the interior space of the room installed with the sound absorber can be achieved.

In addition, a first layer member disposed at the sound absorbing face may be configured to have a density higher than that of a second layer member disposed further than the sound absorbing face in the depth direction. According to this configuration, the first layer member having a high density can reflect sound appropriately. Therefore, more comfortable reverberation can be achieved.

Furthermore, each of the layer members may be made of a nonwoven fabric. The nonwoven fabric enables proper sound absorption and sound reflection.

Advantageous Effects of Invention

According to the soundproof room, the sound absorber included in the soundproof room has a varying depth dimension from the sound absorbing face, which absorbs sound, toward a depth direction. When sound enters through the sound absorbing face exposed in the room, the relatively thick part can efficiently absorb sounds with long wavelengths in a low audio frequency range, while both the relatively thick part and the relatively thin part can efficiently absorb sounds with short wavelengths in a high audio frequency range. In short, the sound absorber can efficiently absorb sounds in a broad audio frequency range from high to low. Since this sound absorber is formed by stacking a plurality of layer members from the sound absorbing face in the depth direction, even if layer members arranged on the sound absorbing face side cannot completely absorb sounds and allow the sounds to pass therethrough, the other layer members arranged further than the sound absorbing face in the depth direction can absorb the sounds permeated. Thus, this sound absorber can absorb sound in the room more properly.

DESCRIPTION OF EMBODIMENT

Figure 1:
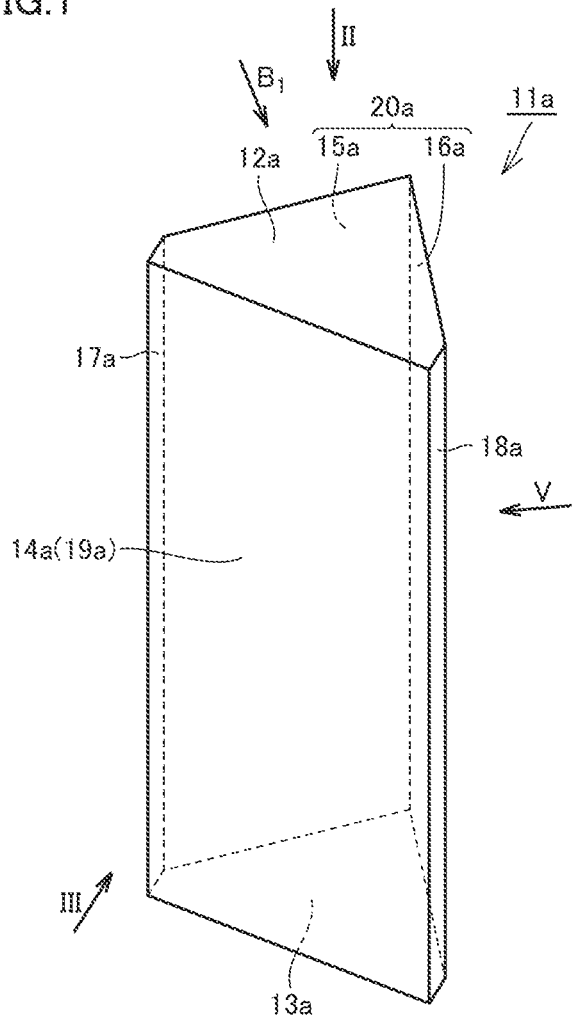
FIG. 1 is a perspective view showing the appearance of a sound absorber to be installed in a soundproof room according to an embodiment of the present invention.
Figure 2:
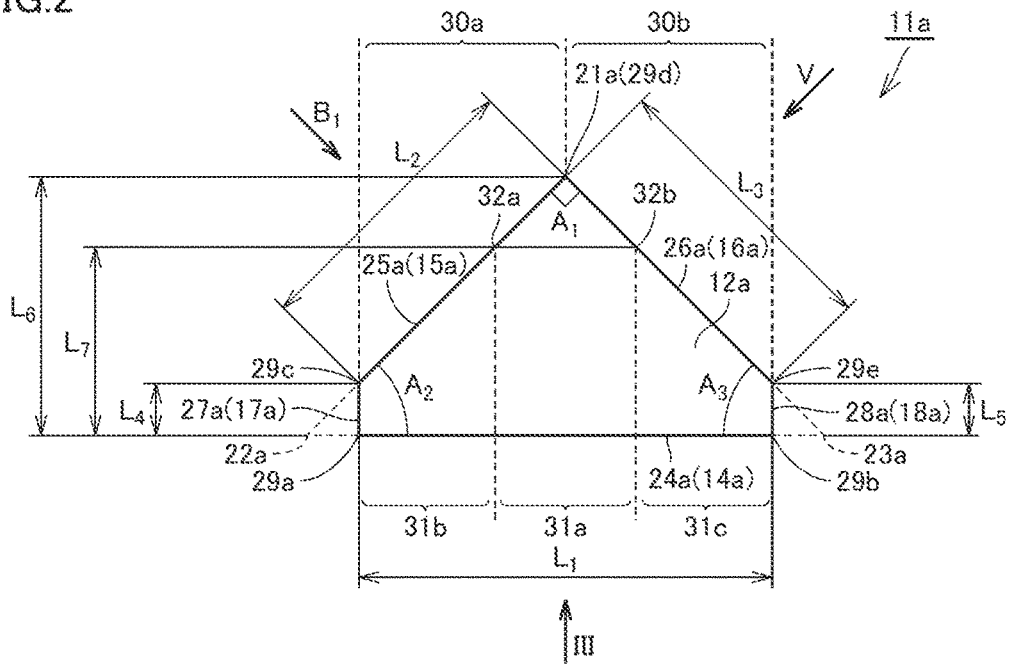
FIG. 2 illustrates the sound absorber in FIG. 1, as viewed in a direction of Arrow II in FIG. 1.
Figure 3:
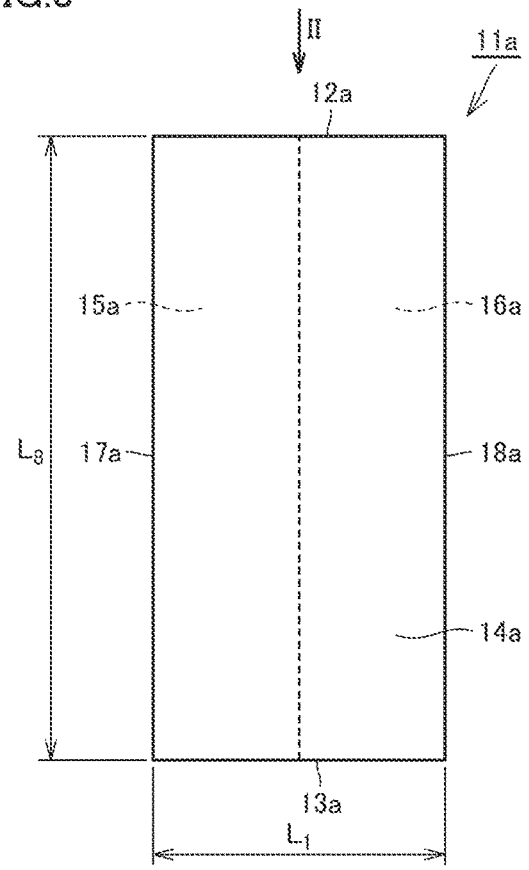
FIG. 3 illustrates the sound absorber in FIG. 1, as viewed in a direction of Arrow III in FIGS. 1 to 2.
Figure 4:
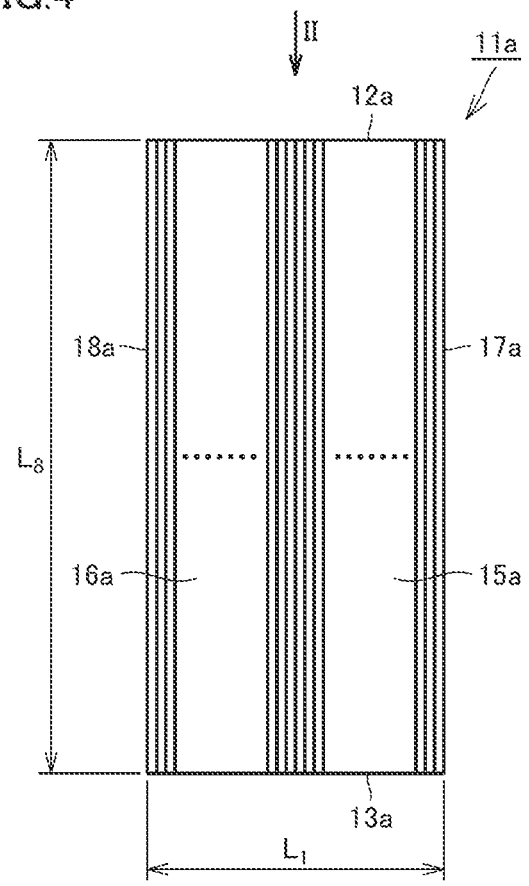
FIG. 4 illustrates the sound absorber in FIG. 1, as viewed in an opposite direction to Arrow III in FIGS. 1 to 2.
Figure 5:
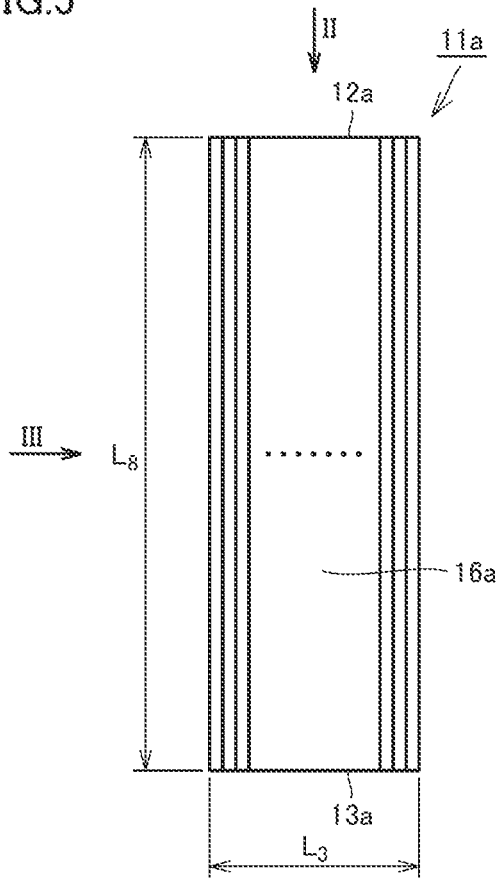
FIG. 5 illustrates the sound absorber in FIG. 1, as viewed in a direction of Arrow V in FIG. 2.

With reference to the drawings, embodiments of the present invention will be described below. FIG. 1 is a perspective view showing the appearance of a sound absorber 11*a* to be installed in a soundproof room according to an embodiment of the present invention. FIG. 2 shows the sound absorber 11*a* in FIG. 1 as viewed in the direction of Arrow II in FIG. 1, that is, FIG. 2 is a so-called top view of the sound absorber 11*a* viewed from above. In order to provide a clear understanding, layer members, which will be described later, are not illustrated in FIG. 2. FIG. 3 illustrates the sound absorber 11*a* in FIG. 1, as viewed in a direction of Arrow III in FIGS. 1 to 2. FIG. 3 corresponds to a front view of the sound absorber 11*a*, as viewed from the side of a sound absorbing face, or a front surface, which will be described later. FIG. 4 illustrates the sound absorber 11*a* in FIG. 1, as viewed in an opposite direction to Arrow III in FIGS. 1 to 2. FIG. 4 corresponds to a back view of the sound absorber 11*a*, as viewed from the side of a back surface, which will be described later. FIG. 5 illustrates the sound absorber 11*a* in FIG. 1, as viewed in a direction of Arrow V in FIG. 2. In order to provide a clear understanding, the illustration of layer members, which will be described later, is partially omitted in FIGS. 3 to 5, and FIGS. 6, 7, and 9, which will be described later. Arrow III in FIGS. 1 to 2 and other drawings indicates the depth direction of the sound absorber 11*a*.

Referring to FIGS. 1 to 5, the sound absorber 11*a* to be installed in the soundproof room according to this embodiment of the invention is approximately in the shape of a triangle prism, or exactly a pentagonal prism. The outer shape of the sound absorber 11*a* is composed of a top face 12*a* located at one end of the pentagonal prism sound absorber 11*a* in the longitudinal direction, a bottom face 13*a* located at the other end in the longitudinal direction, a first side face 14*a*, a second side face 15*a*, a third side face 16*a*, a fourth side face 17*a*, and a fifth side face 18*a*, which are side surfaces of the sound absorber 11*a* and extend along the longitudinal direction. The second side face 15*a* and third side face 16*a* are adjacent to each other. The fourth side face 17*a* is provided between the first side face 14*a* and the second side face 15*a*. The fifth side face 18*a* is provided between the first side face 14*a* and the third side face 16*a*. The top face 12*a* and bottom face 13*a* are in the shape of a pentagon, while the first side face 14*a*, second side face 15*a*, third side face 16*a*, fourth side face 17*a*, and fifth side face 18*a* are all in the shape of a rectangle. Among the first side face 14*a*, second side face 15*a*, third side face 16*a*, fourth side face 17*a*, and fifth side face 18*a*, the first side face 14*a* has the largest area. The second side face 15*a* and third side face 16*a* are designed to have an equal area that is the second largest. The fourth side face 17*a* and fifth side face 18*a* are also designed to be equal in area. If FIG. 5 shows the second side face 15*a* viewed in the direction of Arrow V in FIG. 2, the second side face 15*a* is symmetrically identical to the third side face 16*a* viewed in the direction of Arrow $B_1$ in FIG. 2.

When the sound absorber 11*a* is installed in the soundproof room, which will be described later, the rectangular first side face 14*a* is referred to as a front face 19*a* that is exposed in the room, while the rectangular second side face 15*a* and third side face 16*a* are referred to as a back face 20*a* that is covered by walls composing the room. Specifically, the first side face 14*a* corresponds to the front face 19*a*, which is exposed in the room, of the sound absorber 11*a*, while the second side face 15*a* and third side face 16*a* correspond to the back face 20*a*, which is covered by walls composing the soundproof room, more concretely, soundproof walls, of the sound absorber 11*a*. The sound absorber 11*a* is installed at a given position in the room with the bottom face 13*a* located vertically on the lower side. That is, the vertical direction corresponds to the downward direction indicated by Arrows II in FIGS. 1, 3 to 5.

The sound absorber 11*a* is a approximately triangular prism having an isosceles right triangle section. Except for a corner 21*a*, which is the right angle corner of the isosceles right triangle, the other two corners, a corner 22*a* and corner 23*a*, more specifically, a corner 22*a* between the first side face 14*a* and second side face 15*a* and a corner 23*a* between the first side face 14*a* and third side face 16*a* are both chamfered as if they are straightly cut off by a predetermined thickness in the longitudinal direction. This removal of the corners 23*a*, 24*a* shapes the fourth side face 17*a* and fifth side face 18*a*. The corner 22*a* and corner 23*a* are indicated by dotted lines in FIG. 2. That is, the sound absorber 11*a* is approximately a triangle in cross section when it is cut along a plane including a line extending from the front face 19*a* to the back face 20*a*.

Referring to the top face 12*a* for the purpose of description, the shape of the top face 12*a*, that is, an isosceles right triangle is presented by a first line 24*a* defining the first side face 14*a*, a second line 25*a* defining the second side face 15*a*, and a third line 26*a* defining the third side face 16*a*. The second line 25*a* and third line 26*a* form an angle $A_1$ of 90 degrees. The first line 24*a* and second line 25*a* form an angle $A_2$ of 45 degrees. The first line 24*a* and third line 26*a* form an angle $A_3$ of 45 degrees. A fourth line 27*a* defining the fourth side face 17*a* and a fifth line 28*a* defining the fifth side face 18*a* are provided so as to straightly extend along the direction of Arrow III, which is an upward direction on the sheet of FIG. 2. Therefore, the sound absorber 11*a* has a varying depth dimension from the front face 19*a* to the back face 20*a*. In other words, the sound absorber has a varying thickness as viewed from the sound absorbing surface toward the depth direction. In this case, since the second side face 15*a* and the third side face 16*a* are inclined surfaces extending with respect to the first side face 14*a*, the thickness of the sound absorber 11*a* continuously varies within a range from the front face 19*a* to back face 20*a*.

Length $L_1$ from one end 29*a* to the other end 29*b* of the first line 24*a* is selectively set to, for example, 46 cm (centimeters). Length $L_2$ from one end 29*c* to the other end 29*d* of the second line 25*a* and length $L_3$ from one end 29*e* to the other end 29*d* of the third line 26*a* are both selectively set to, for example, 35 cm. Length $L_4$ from one end 29*a* to the other end 29*c* of the fourth line 27*a* and length $L_5$ from one end 29*b* to the other end 29*e* of the fifth line 28*a* are both selectively set to, for example, 2 cm. Length $L_6$ of the perpendicular bisector extending from the corner 21*a* between the second line 25*a* and third line 26*a* to the first line 24*a* is selectively set to, for example, 25 cm. The sound absorber 11*a* set as above includes a first segment 31*a* with a length in the thickness direction from the front face 19*a* to the back face 20*a* of 23 cm or longer, and second segments 31*b*, 31*c* with a length in the thickness direction from the front face 19*a* to the back face 20*a* of less than 23 cm. In other words, the sound absorber 11*a* includes a first segment 31*a* with a depth dimension from the sound absorbing face of 23 cm or greater, and second segments 31*b*, 31*c*, each with a depth dimension from the sound absorbing face of less than 23 cm. The second segment 31*b* is located near the second side face 15*a*, while the second segment 31*c* is located near the third side face 16*a*. The position of 23 cm from the first side face 14*a* in the thickness direction is indicated by a dot 32*a* on the second side face 15*a* side and a dot 32*b* on the third side face 16*a* side. Lengths $L_7$ of normal lines drawn from the first line 24*a* to the dot 32*a* and from the first line 24*a* to the dot 32*b* are 23 cm, respectively.

By the way, the sound absorber 11*a* includes a maximum depth region whose depth dimension is the greatest and depth increasing regions whose depth dimension increases while approaching the maximum depth dimension from the sound absorbing face, the depth increasing regions being adjacent to the maximum depth region. Specifically, the maximum depth region having the maximum depth dimension corresponds to the region where the corner 21*a* between the second line 25*a* and third line 26*a* is located. The depth increasing regions, which are adjacent to the maximum depth region and increase their depth dimensions while approaching the maximum depth dimension from the sound absorbing face, correspond to regions 30*a*, 30*b* containing the second side face 15*a* and third side face 16*a*, respectively.

Length $L_8$ in the longitudinal direction, that is, in the height direction, from the top face 12*a* to bottom face 13*a* is selectively set to, for example, 240 cm. The length $L_1$ may be sometimes regarded as a length in a lateral direction, or a shorter side direction, that is a width direction. In addition, the longitudinal direction equivalent to the height direction may be sometimes referred to as a vertical direction.

Figure 6:
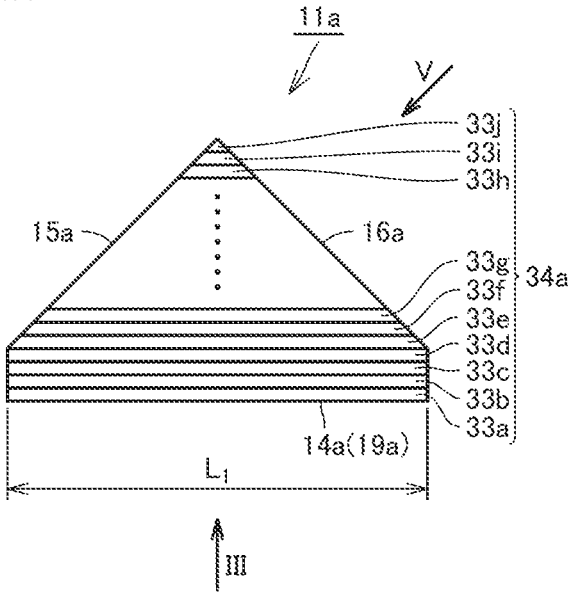
FIG. 6 illustrates the sound absorber in FIG. 1, as viewed in a direction of Arrow II in FIG. 1.
Figure 7:
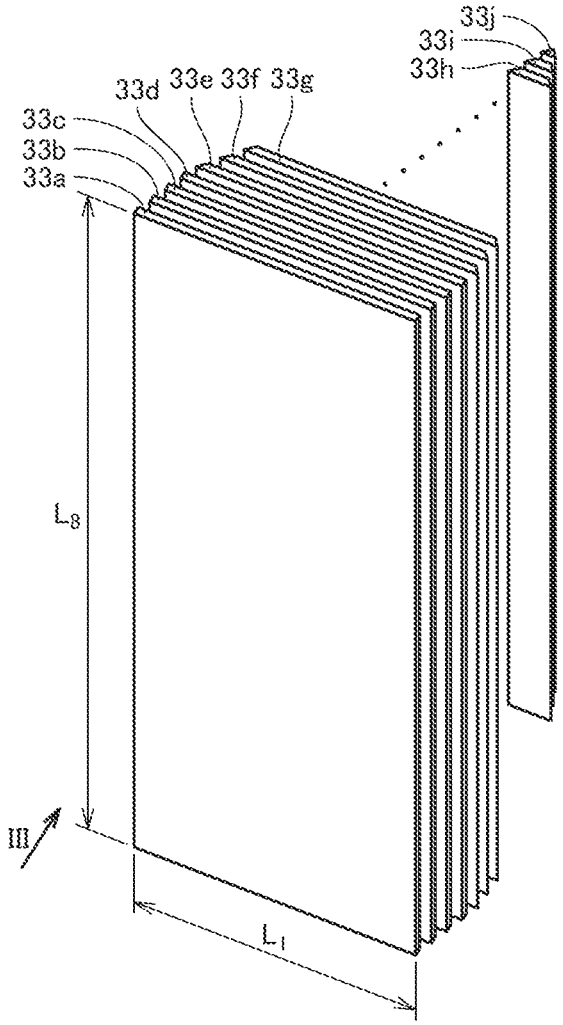
FIG. 7 is a perspective exploded view showing the sound absorber disintegrated into a plurality of layer members.
Figure 8:
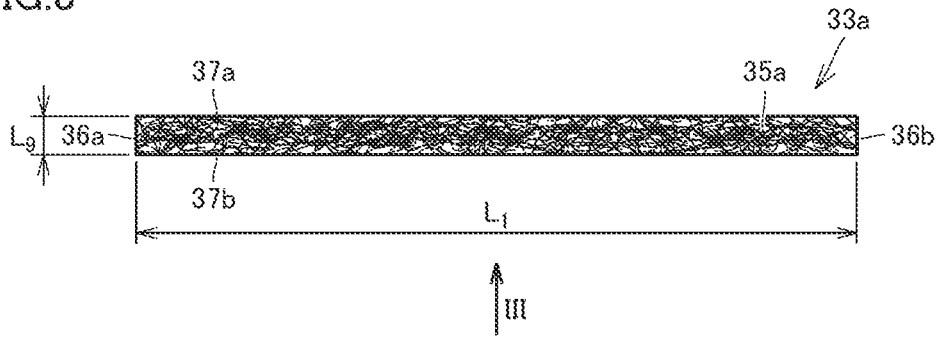
FIG. 8 is a schematic cross-sectional view showing one of the layer members making up the sound absorber.

The sound absorber 11*a* is formed by stacking a plurality of layer members 33*a*, 33*b*, 33*c*, 33*d*, 33*e*, 33*f*, 33*g*, 33*h*, 33*i*, and 33*j*. FIG. 6 illustrates the sound absorber 11*a* in FIG. 1, as viewed from above, more specifically, in a direction of Arrow II in FIG. 1. The view of FIG. 6 corresponds to that of FIG. 2, and shows the layer members 33*a* to 33*j* which are merely part of the layer members. FIG. 7 is a perspective exploded view showing the sound absorber 11*a* disintegrated into the layer members 33*a* to 33*j*. FIG. 8 is a schematic cross-sectional view showing the layer member 33*a* which is one of the layer members making up the sound absorber 11*a*.

Referring to FIGS. 1 to 8, the sound absorber 11*a* is a so-called layered structure 34*a* formed by stacking the plurality of layer members 33*a* to 33*j*. A description will be made about the configuration of the layer member 33*a* that is located closest to the front face 19*a*, or the sound absorbing face, and composes the first side face. The layer member 33*a* is made of a nonwoven fabric. More specifically, the layer member 33*a* is made of polyester-based fibers 35*a*, and more concretely, is a layered member made by intricately intertwining a plurality of PET (Polyethylene terephthalate) fibers with a predetermined length. Other materials selected for the layer member 33*a* are, for example, glass wool, rock wool, etc.

Length $L_1$ from a lateral end face 36*a* to a lateral end face 36*b* of the layer member 33*a* is equivalent to the lateral length $L_1$ of the first side face 14*a*. The end face 36*a* forms a part of the fourth side face 17*a*, and the end face 36*b* forms a part of the fifth side face 18*a*. The thickness of the layer member 33*a* or, more specifically, the length, which is indicated by $L_9$ in FIG. 8, between a face 37*a* located upward with respect to the direction of the thickness of the layer member 33*a* and the other face 37*b* located downward with respect to the thickness direction, is approximately a few mm (millimeters). The face 37*a* forms a part of the top face 12*a*, and the face 37*b* forms a part of the bottom face 13*a*. The other layer members 33*b* to 33*j* are composed of the same materials as the layer member 33*a*, but have different densities, or different weight per unit volume from the layer member 33*a*. Specifically, the layer member 33*a* located closest to the front face 19*a* is configured to have a density higher than the densities of the other layer members 33*b* to 33*j*. By placing the layer member 33*a* with the highest density at the closest position to the front face 19*a*, a certain degree of sound is reflected at the first side face 14*a*, that is the front face 19*a*. Reflection of the certain degree of sound is effective to provide reverberation in the room. The sound absorber 11*a*, which is a layered structure 34*a*, is formed by stacking such layer members 33*a* to 33*j* in the thickness direction, or the depth direction.

To stack the layer members 33*a* to 33*j*, each of the layer members 33*a* to 33*j* is joined to the adjacent one of the layer members 33*a* to 33*j* so as to intertwine their fibers with each other at a certain degree. Consequently, the sound absorber 11*a* formed by stacking the layer members 33*a* to 33*j* is treated as a piece of layered structure 34*a*, and even if the sound absorber 11*a* is lifted up, the sound absorber 11*a* will not disintegrate into individual layer members 33*a* to 33*j*. It is not necessary to make the borders between the layer members 33*a* to 33*j* clear enough to be perceived by eyes or other types of visual check. For example, the layered structure 34*a* may be configured so that high-density parts and low-density parts appear alternately. It is of course possible to interpose an adhesive member or a holding member between the opposed surfaces of the adjacent layer members 33*a* to 33*j*. It is also possible to apply pressure to the stacked layer members 33*a* to 33*j* in the direction along which the layer members 33*a* to 33*j* are stacked in order to somewhat intertwine the fibers on the surfaces of the respective layer members 33*a* to 33*j*, thereby forming the layered structure 34*a*.

Among the layer members 33*a* to 33*j*, some layer members having the same size are disposed near the first side face 14*a*. More specifically, in this embodiment, four layer members 33*a* to 33*d* with the same length $L_8$ in the longitudinal direction and the same length $L_1$ in the shorter side direction are stacked on the side of the first side face 14*a*. From the midpoint of the layered structure 34*a* in the stack direction, the layer members 33*e* to 33*j* with the same length $L_8$ in the longitudinal direction, but different lengths $L_1$ in the shorter side direction, are stacked so that the layered structure 34*a* gradually becomes shorter in the shorter side direction. In short, the layer members 33*a* to 33*j* are stacked so as to form the shape shown in FIGS. 2 and 6 when viewed from the top face 12*a* or bottom face 13*a*. In this embodiment, the edges of the layer members 33*e* to 33*j* are beveled. In addition, the layer member 33*j*, which is located furthest from the front face 19*a*, is shaped into a triangular prism. The sound absorber 11*a* is configured so that its thickness in the stack direction indicated by Arrow III in FIG. 6 continuously varies, and more specifically, the thickness of the sound absorber 11*a* is the greatest at the lateral center in the left-to-right direction on the sheet of FIG. 6, and the length $L_1$ in the shorter side direction extending toward the end faces 36*a*, 36*b* in the left-to-right direction continuously becomes shorter. In short, the second side face 15*a* and third side face 16*a* are configured to be inclined straightly with respect to the first side face 14*a*. In this embodiment, each end face of the layer members 33*e* to 33*j* defines the back face 20*a* of the sound absorber 11*a*.

Figure 9:
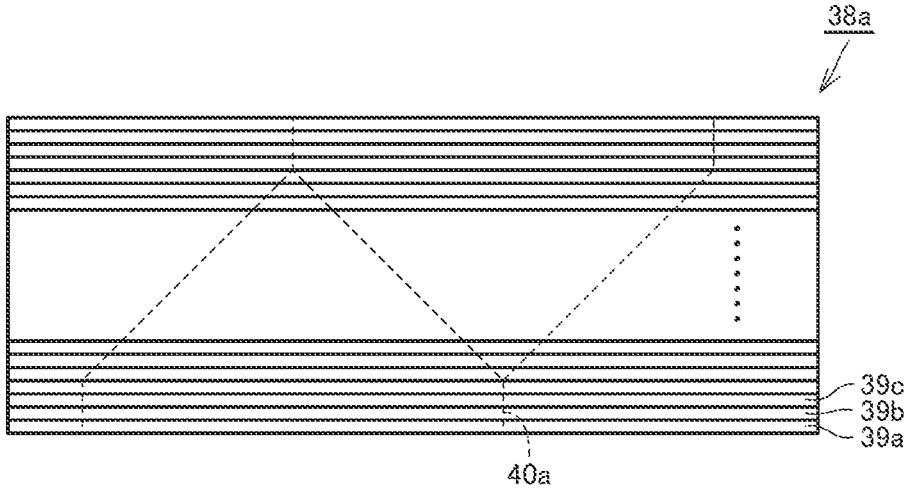
FIG. 9 is a cross-sectional view showing a part of a semifinished product in a manufacturing process of an example method for manufacturing the sound absorber.
Figure 10:
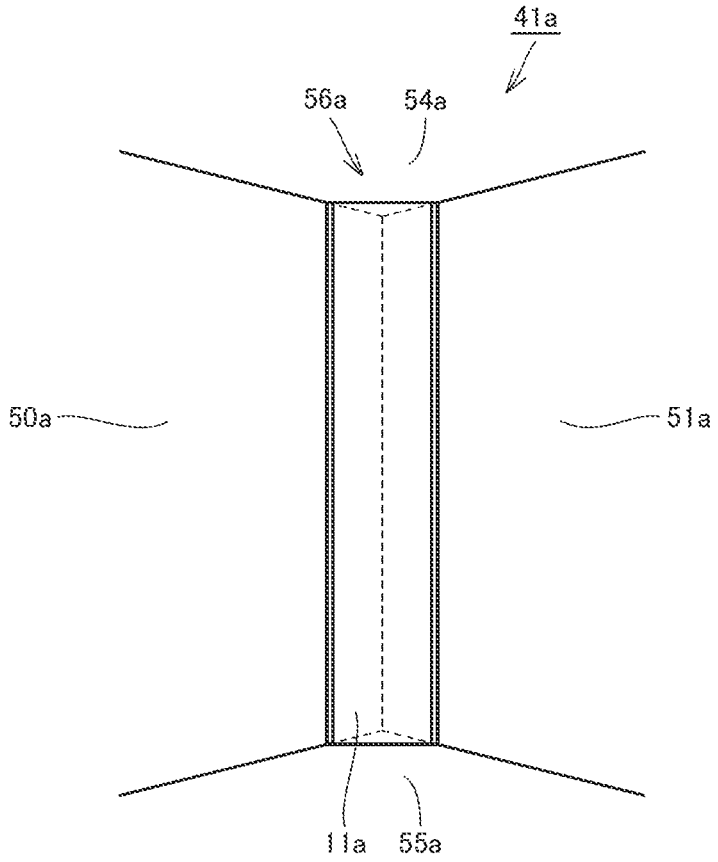
FIG. 10 is a schematic perspective view showing a part of a soundproof room according to the embodiment of the invention.

The following is a brief description about an example method for manufacturing the above-described sound absorber 11*a*. FIG. 9 is a cross-sectional view partially showing a semifinished product 38*a* in a manufacturing process of the method for manufacturing the sound absorber 11*a*. Referring to FIG. 9, firstly, a plurality of layer members 39*a*, 39*b*, 39*c* of the same lengthwise and widthwise dimensions are stacked on top of each other. Then, the semifinished product 38*a* is cut into the shape of a finished product, that is, the sound absorber 11*a*. The dotted lines in FIG. 9 indicate sections 40*a* to be cut at this stage. The sound absorber 11*a* can be manufactured in this manner. This method can manufacture the sound absorber 11*a* more efficiently.

For a case where the sound absorber 11*a* is installed in a soundproof room, which will be described later, the sound absorber 11*a* can be configured to include a detachable mechanism enabling attachment and detachment of the sound absorber 11*a* to/from the soundproof room. Available detachment mechanisms include, for example, a stopper, a fastener, and so on that can hold the sound absorber 11*a* on walls in the soundproof room. Alternatively, the undermentioned soundproof room can be configured to include a mounting member. Furthermore, the sound absorber 11*a* can be equipped with a transport means, such as casters, at the lower side of the bottom face 13*a*. The transport means facilitate movement of the sound absorber 11*a* when the sound absorber 11*a* is installed in or removed from the soundproof room.

A description will be made about a soundproof room according to the embodiment of the present invention. FIG.

Figure 11:
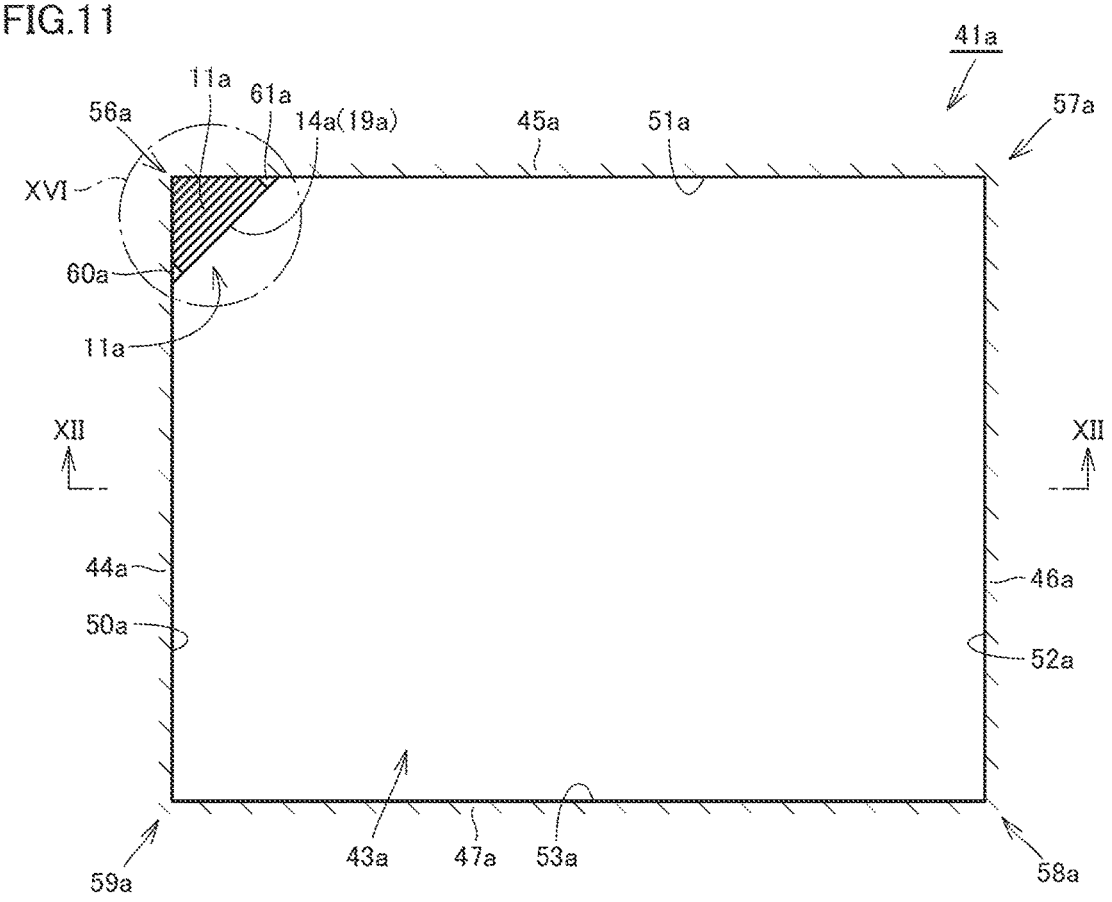
FIG. 11 is a schematic cross-sectional view of the soundproof room according to the embodiment of the invention, as viewed from the ceiling side.
Figure 12:
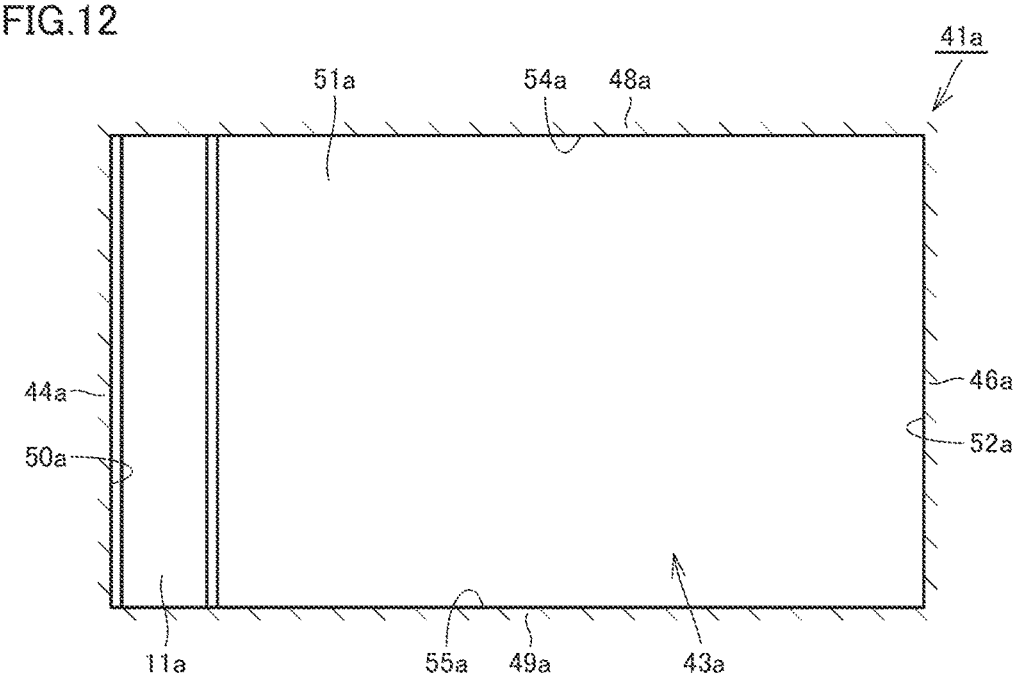
FIG. 12 is a cross-sectional view of the soundproof room taken along Line XII-XII in FIG. 11.
Figure 13:
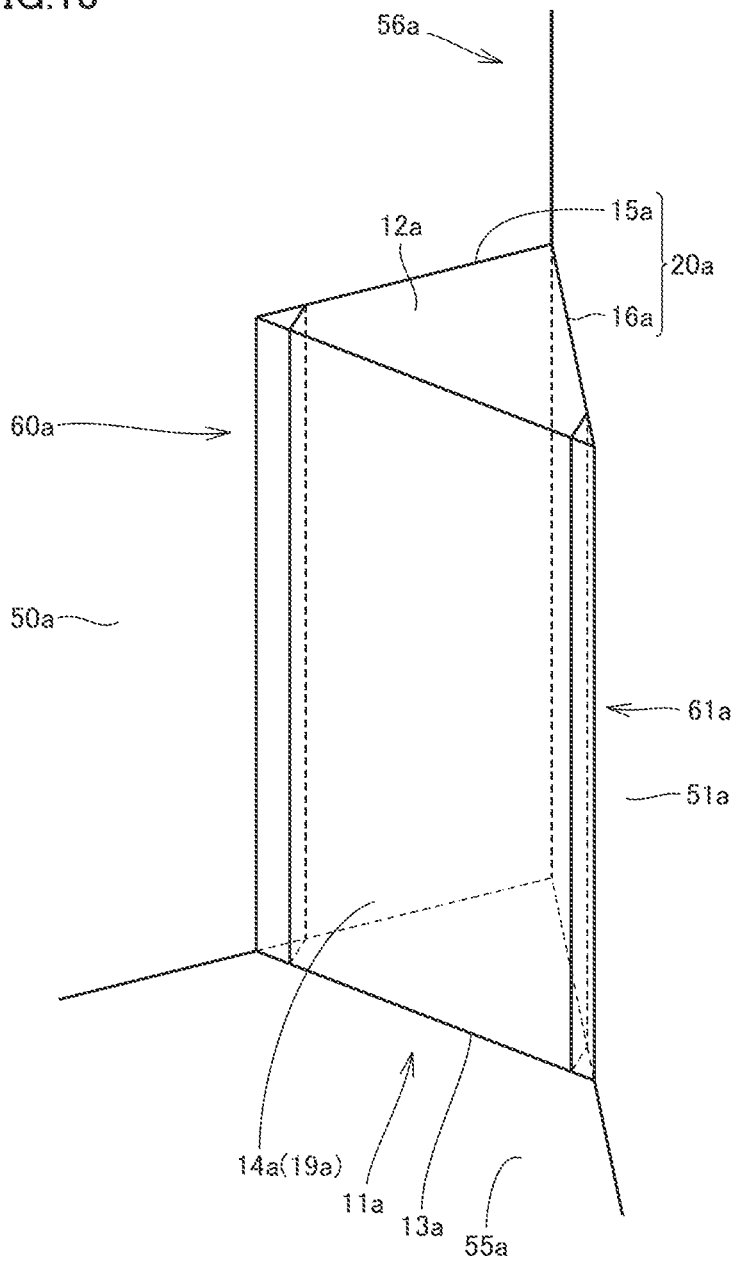
FIG. 13 is an enlarged view of an area where the sound absorber is installed in the soundproof room.
Figure 14:
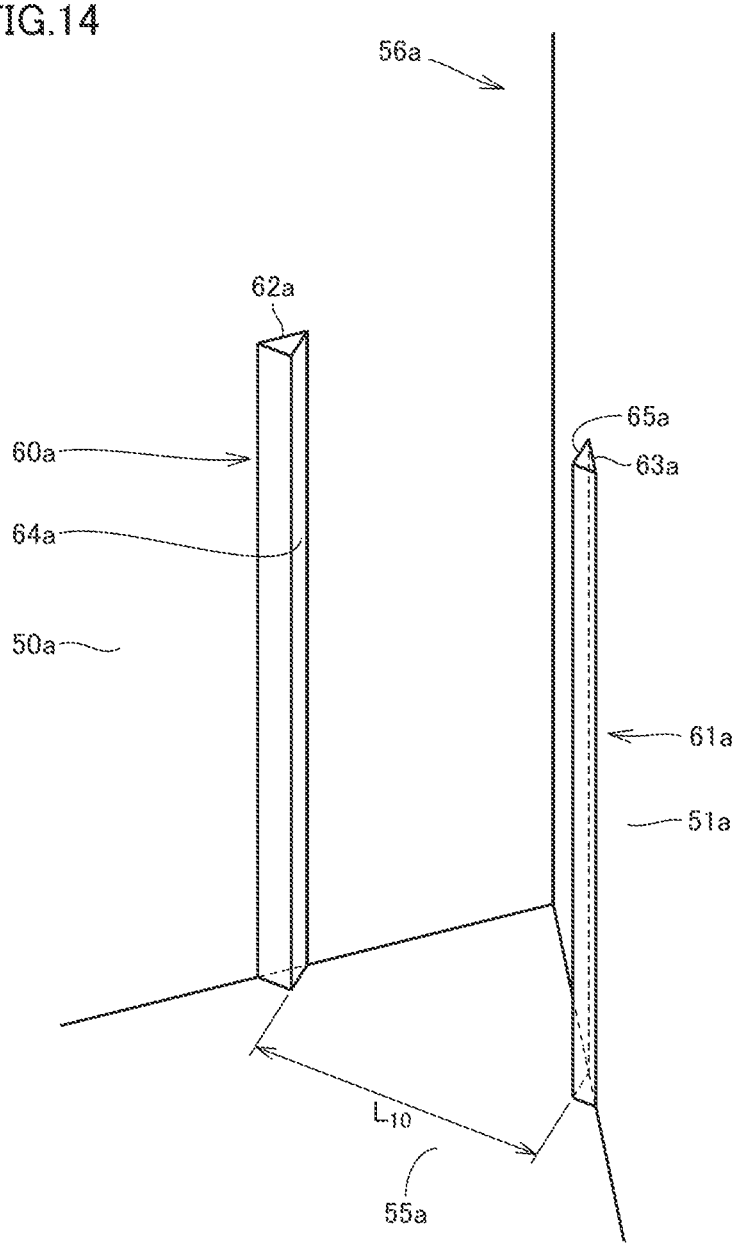
FIG. 14 is an enlarged view of the area where the sound absorber is removed in the soundproof room.

10 is a schematic perspective view showing a part of a soundproof room 41*a* according to the embodiment of the invention. FIG. 11 is a schematic cross-sectional view of the soundproof room 41*a* according to the embodiment of the invention, as viewed from a ceiling 48*a*, which will be described later. FIG. 12 is a cross-sectional view of the soundproof room 41*a* taken along XII-XII in FIG. 11. FIGS. 13 and 14 are both enlarged views of an area where the sound absorber 11*a* is installed in the soundproof room 41*a*, but FIG. 14 shows the area without the sound absorber 11*a*. In the interest of clarity, FIGS. 13 and 14 omit a part of the sound absorber 11*a* and undermentioned mounting member, more concretely, an upper part in the height direction of the sound absorber 11*a*. Also, hatching is omitted in some drawings.

Referring to FIGS. 10 to 14, the soundproof room 41*a* according to the embodiment of the present invention allows the playing of musical instruments (not shown) or other performances to be held in an interior space 43*a* thereof and is equipped with a soundproof structure. This means that the soundproof room 41*a* to be described below is constructed with soundproof walls. The soundproof room 41*a* is provided with a sound absorber 11*a* configured as shown in FIG. 1. The soundproof room 41*a* is composed of four walls 44*a*, 45*a*, 46*a*, 47*a*, a ceiling 48*a*, and a floor 49*a*. The walls 44*a*, 45*a*, 46*a*, 47*a*, ceiling 48*a*, and floor 49*a* have flat wall surfaces 50*a*, 51*a*, 52*a*, 53*a*, a flat ceiling surface 54*a*, and a flat floor surface 55*a*, respectively, on the side of the interior space 43*a* of the soundproof room 41*a*. The wall surfaces 50*a* and 51*a* are provided so as to oppose to the wall surfaces 52*a* and 53*a*, respectively. The ceiling surface 54*a* is provided so as to oppose to the floor surface 55*a* in the vertical direction. The soundproof room 41*a* is in the shape of approximately a so-called rectangular parallelepiped. Specifically, the walls 44*a*, 45*a*, 46*a*, 47*a* of the soundproof room 41*a* compose four corner portions 56*a*, 57*a*, 58*a*, 59*a*, and the corner portions 56*a*, 57*a*, 58*a*, 59*a* formed with the wall surfaces 50*a*, 51*a*, 52*a*, 53*a* have an angle of 90 degrees as viewed from the ceiling 48*a*. The soundproof room 41*a* is designed large enough to hold various types of playing of musical instruments, such as a drum, piano, tuba, and cello, in the interior space 43*a* thereof. Though it is not illustrated, the soundproof room 41*a* is also provided with necessary lighting equipment and a door or some kinds of access means through which people, musical instruments, etc. enter and exit the room.

Mounting members 60*a*, 61*a* that are used to mount the sound absorber 11*a* are provided on adjacent wall surfaces 50*a* and 51*a*. The location of the mounting members 60*a*, 61*a* is in the vicinity of a corner portion 56*a*, which is a corner of the soundproof room 41*a* formed with the wall surfaces 50*a* and 51*a*. Both the mounting members 60*a*, 61*a* are triangular prisms with the cross section of an isosceles right triangle if they are cut through by a plane perpendicular to the longitudinal direction. The mounting member 60*a* is attached to a wall surface 50*a* with its side face 62*a*, which defines the longer side of the isosceles right triangle, abutting against the wall surface 50*a*. Similarly, the mounting member 61*a* is attached to a wall surface 51*a* with its side face 63*a*, which defines the longer side of the isosceles right triangle, abutting against the wall surface 51*a*. When the mounting members 60*a*, 61*a* are respectively provided on the wall surfaces 50*a*, 51*a*, their side faces 64*a*, 65*a*, each defining a shorter side of the isosceles right triangle, are opposed to each other. Length $L_{10}$ between the side face 64*a* and side face 65*a* is nearly equal to, or, just to be on the safe side, somewhat longer than the length $L_1$, which is the lateral length of the first side face 14*a* of the sound absorber 11*a*.

The sound absorber 11*a* is fit into the mounting members 60*a*, 61*a* for installation. Specifically, the sound absorber 11*a* is installed at the corner portion 56*a* formed with the wall 44*a* and the wall 45*a* of the soundproof room 41*a*. The sound absorber 11*a* installed there is removable from the soundproof room 41*a*. The first side face 14*a* of the sound absorber 11*a* serves as the front face 19*a*, that is exposed in the soundproof room 41*a*. In addition, the second side face 15*a*, which composes a part of the back face 20*a* of the sound absorber 11*a*, faces the wall surface 50*a*, while the third side face 16*a*, which composes the other part of the back face 20*a* of the sound absorber 11*a*, faces the wall surface 51*a*. In short, the back face 20*a* of the sound absorber 11*a* is covered with the walls 44*a*, 45*a*, more concretely, with the wall surfaces 50*a*, 51*a*. The second side face 15*a* and third side face 16*a* are configured so as make contact with the wall surface 50*a* and wall surface 51*a*, respectively, or so as to allow very little clearance to be left between the second side face 15*a* and wall surface 50*a*, and between the third side face 16*a* and the wall surface 51*a*. In this case, the fourth side face 17*a* is also covered with the wall surface 50*a*. In other words, the fourth side face 17*a* is configured so as to make contact with the wall surface 50*a*, or so as to allow very little clearance to be left between the fourth side face 17*a* and the wall surface 50*a*. In addition, the fifth side face 18*a* is also covered with the wall surface 51*a*. In other words, the fifth side face 18*a* is configured so as to make contact with the wall surface 51*a*, or so as to allow very little clearance to be left between the fifth side face 18*a* and the wall surface 51*a*. The top face 12*a* is opposed to the ceiling surface 54*a*, and the bottom face 13*a* is opposed to the floor surface 55*a*. Specifically, the top face 12*a* and bottom face 13*a* are configured so as to make contact with the ceiling surface 54*a* and floor surface 55*a*, respectively, or so as to allow very little clearance to be left between the top face 12*a* and ceiling surface 54*a*, and between the floor surface 55*a* and bottom face 13*a*.

According to the soundproof room 41*a*, the sound absorber 11*a* included in the soundproof room 41*a* has a varying thickness as viewed from the front face 19*a*, which serves as a sound absorbing face that absorbs sound, toward the depth direction. When sound enters through the sound absorbing face exposed in the soundproof room 41*a*, the relatively thicker part can efficiently absorb sounds with long wavelengths in a low audio frequency range, while both the relatively thick part and the relatively thin part can efficiently absorb sounds with short wavelengths in a high audio frequency range. In short, the sound absorber 11*a* can efficiently absorb sounds in a broad audio frequency range from high to low. Since the sound absorber 11*a* is formed by stacking the layer members 33*a* to 33*j* from the sound absorbing face in the depth direction, even if the layer members arranged on the sound absorbing face side cannot completely absorb sounds and allow the sounds to pass therethrough, the other layer members arranged further than the sound absorbing face in the depth direction can absorb the sounds permeated. Therefore, this soundproof room 41*a* can absorb sound in the room more properly.

Figure 15:
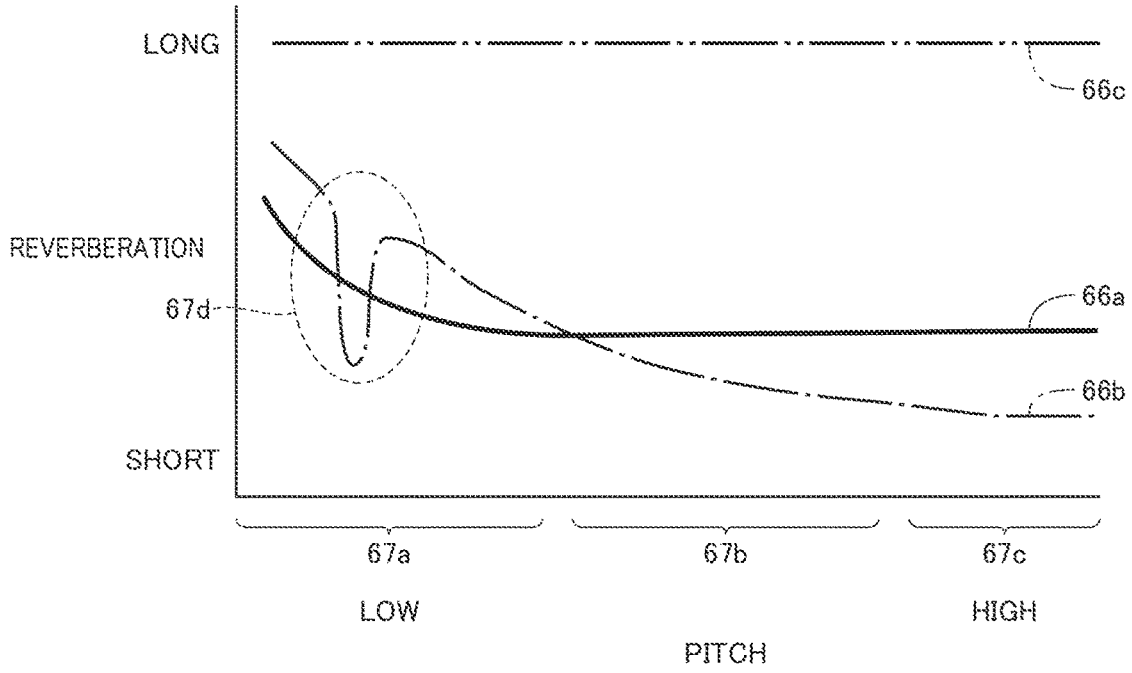
FIG. 15 is a graph showing the relationship between the reverberation and sound pitch in the soundproof room.

The following is a detailed description about the sound absorption. FIG. 15 is a graph showing the relationship between reverberant sound, that is, reverberation and pitch of sound in the soundproof room 41*a*. In FIG. 15, the vertical axis represents the degree of the reverberant sound, while the horizontal axis represents the pitch of sound. Along the vertical axis, the sound is reverberated more, or the reverberant sound is prolonged toward the upper end of the vertical axis, while the sound is reverberated less, or the reverberant sound is shortened toward the lower end of the vertical axis. On the other hand, along the horizontal axis, the pitch becomes higher, or the audio frequency range becomes higher toward the right end of the horizontal axis, while the pitch becomes lower, or the audio frequency range becomes lower toward the left end of the horizontal axis. In FIG. 15, the solid line 66*a* indicates a measurement result of the soundproof room 41*a* according to the embodiment of the invention, the dot-and-dash line 66*b* indicates a measurement result of a conventional sound absorbing material, and for reference purposes, the dashed double-dotted line 66*c* indicates a measurement result when no sound absorbing material was used, that is, sound absorption was not carried out. The conventional sound absorbing material herein is a flat plate-like sound absorbing material, such as an acoustical panel, with a constant thickness, or approximately 10 mm. The graph in FIG. 15 indicates the relationship in a relative manner to provide a clear understanding, and therefore, a description will be made with the horizontal axis that is roughly classified into a low audio frequency range 67*a*, a middle audio frequency range 67*b*, and a high audio frequency range 67*c*. For example, the low audio frequency range 67*a* denotes an octave band with a center frequency of 125 Hz, while the high audio frequency range 67*c* denotes an octave band with a center frequency of 500 Hz. The middle audio frequency range 67*b* denotes an octave band between the low audio frequency range 67*a* and high audio frequency range 67*c*.

With reference to FIG. 15, in the case where no sound absorbing material is used as indicated by the dashed double-dotted line 66*c* in FIG. 15, the sound is of course not absorbed, and therefore is reverberated for a long time across all ranges from the low audio frequency range 67*a* to the high audio frequency range 67*c*. Such reverberation is not preferable at all. In the case where a conventional sound absorbing material is used as indicated by the dot-and-dash line 66*b* in FIG. 15, the sound is absorbed evenly in comparison with the case without any sound absorbing material, and therefore the reverberation time can be somewhat shortened toward the high audio frequency range 67*c*. However, the conventional sound absorbing material drastically absorbs only the sound in a certain frequency range in the range 67*d*, encircled by a dotted line in FIG. 15. Actually, the reverberation time of the sound in the certain frequency range is short, but the sound in ranges somewhat higher or lower than the range is not absorbed well and its reverberation time is long. In addition, the conventional sound absorbing material excessively absorbs sound in an ascending manner from the middle audio frequency range 67*b* to the high audio frequency range 67*c*, and consequently, the reverberation time of the sound in the high audio frequency range 67*c* is shortened. This reverberation makes the sound in the high audio frequency range 67*c* typically husky, while prolonging the sound in the low audio frequency range 67*a* noticeably, and consequently an unbalanced reverberation is not anywhere near what the people playing music desire.

On the other hand, in the case of the soundproof room 41*a* according to the embodiment of the invention, the sound absorber 11*a* absorbs sound in the low audio frequency range 67*a* at a gradually increasing absorption rate with an increase in pitch, thereby shortening the reverberation time. The absorption rate of the sound absorber 11*a* exhibits nearly constant values from the middle audio frequency range 67*b* to the high audio frequency range 67*c*, and is maintained when the reverberation time of the sound becomes short to a certain degree. The sound absorber 11*a* provides this reverberation effect. Such reverberation exhibits good balance and is desirable, for example, for people who play music in the soundproof room 41*a*.

Figure 16:
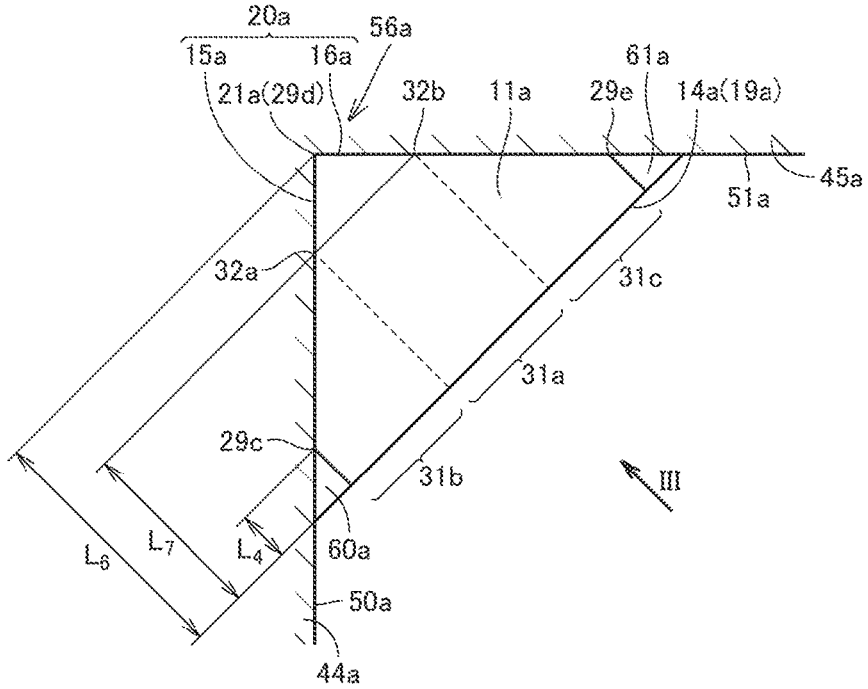
FIG. 16 is an enlarged view of the area, indicated by XVI in FIG. 11, where the sound absorber is installed in the soundproof room according to the embodiment of the invention.

These results possibly come from the following reasons. FIG. 16 illustrates an area where the sound absorber 11*a* is placed in the soundproof room 41*a* according to the embodiment of the invention on an enlarged scale, and also is an enlarged view of the area encircled by XVI in FIG. 11. The sound absorber 11*a* in FIG. 16 is equivalent to that in FIG. 2. Referring to FIG. 16, the sound absorber 11*a* installed in the soundproof room 41*a* according to the embodiment of the invention has a varying thickness as viewed from the sound absorbing face toward the depth direction. In this description, the sound absorber 11*a* is roughly divided, based on the difference in thickness, into a first segment 31*a* with a length in the thickness direction from the front face 19*a* to the back face 20*a* of 23 cm or longer, and second segments 31*b*, 31*c* each with a length in the thickness direction from the front face 19*a* to the back face 20*a* of less than 23 cm. The first segment 31*a* absorbs sound in the low audio frequency range 67*a*. In a case of a sound with a frequency of 125 Hz, which is a typical frequency of the extremely low-pitched sounds of pianos, for example, the wavelength of the sound is approximately 2.72 m. Since it is considered that a sound absorbing material having a thickness of one twelfth of the frequency of a sound can absorb the sound, 2720 cm/12=approximately 23 cm. Thus, if the length of the first segment 31*a* in the thickness direction is set to be 23 cm or longer, the sound absorber 11*a* can reliably absorb the sound of frequency 125 Hz. In case of dimension errors during manufacture of the sound absorber 11*a*, a length of 25 cm is ensured for length $L_6$, which is the length of the first segment 31*a* in the thickness direction. In addition to the first segment 31*a*, the second segments 31*b*, 31*c* each with a length less than 23 cm can absorb sounds in the high audio frequency range 67*c* whose wavelengths are shorter than 23 cm, for example, a sound with a frequency of 500 Hz. Accordingly, the first segment 31*a*, which is regarded as a sound absorbing area for sounds in the low audio frequency range 67*a*, is configured to be relatively small, while the first segment 31*a* and second segments 31*b*, 31*c*, which are regarded as a sound absorbing area for sounds in the high audio frequency range 67*c*, are configured to be relatively large. The absorption rate for the sounds in the low audio frequency range 67*a*, more specifically in an octave band with a center frequency of 125 Hz is set to 0.5 or higher, while the absorption rate for the sounds in the high audio frequency range 67*c*, more specifically in an octave band with a center frequency of 500 Hz is set to 0.8 to 1.0. Setting the absorption rate for the sounds in the octave band with a center frequency of 125 Hz to a value lower than 0.5, for example 0.4 or 0.3, may impair the comfortable bass sounds for players and listeners. On the other hand, if the absorption rate for the sounds in the octave band with a center frequency of 500 Hz is set to a value less than 0.8, for example 0.7 or 0.6, sounds in a high audio frequency range are not absorbed sufficiently and reverberates too much, which may cause offensive sound for the players and listeners. However, the sound absorber 11*a* becomes continuously thinner, more specifically, the sound absorber 11*a* includes a maximum depth region whose depth dimension from the sound absorbing face to the corner 21*a* is the greatest, and depth increasing regions 30*a*, 30*b* that are located adjacent to the maximum depth region and have a depth dimension increasing while approaching the maximum depth dimension from the sound absorbing face, thereby efficiently and continuously absorbing sounds across the low to high audio frequency ranges smoothly. Thus, the sound absorber 11*a* can also efficiently absorb sounds in the middle audio frequency range 67*b* between the low audio frequency range 67*a* and high audio frequency range 67*c*.

With the above-describe configuration, the soundproof room 41*a* according to the embodiment of the invention can achieve more proper sound absorption in the room. In short, setting the absorption rate of the sound absorber 11*a* for sounds in an octave band with a center frequency of 125 Hz to 0.5 or higher, and setting the absorption rate of the sound absorber 11*a* for sounds in an octave band with a center frequency of 500 Hz to from 0.8 to 1.0 can provide more appropriate reverberation.

Although the sound absorber 11*a* in this embodiment is approximately triangular in cross section, the present invention is not limited thereto, and, for example, the sound absorber 11*a* may have the following cross section.

Figure 17:
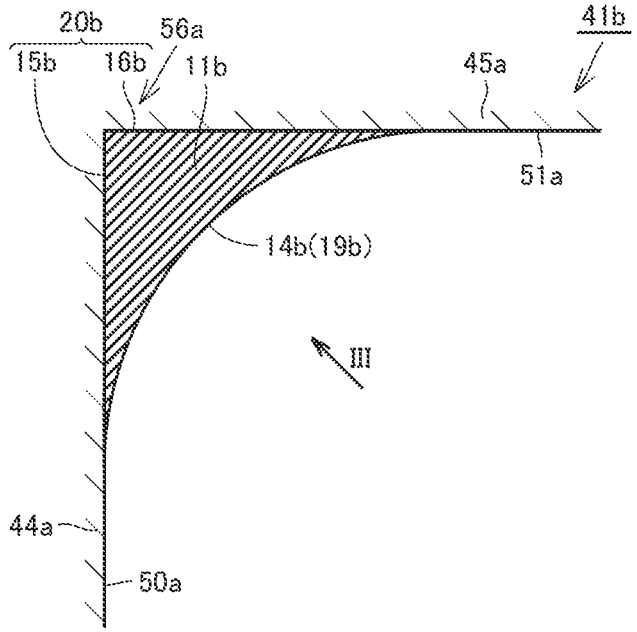
FIG. 17 is a cross-sectional view of a soundproof room according to another embodiment of the invention.

FIG. 17 is a cross-sectional view of a soundproof room 41*b* according to another embodiment of the present invention. FIG. 17 shows an equivalent area to the area XVI in FIG. 11. In the embodiment shown in FIG. 17, like components are denoted by like numerals as of FIG. 11 and the other drawings and therefore the description thereof will not be reiterated. This is applied to the following drawings.

Referring to FIG. 17, the soundproof room 41*b* of this embodiment of the invention includes a sound absorber 11*b*. The structure of walls and other components making up the soundproof room 41*b* is the same as that shown in FIG. 10 and some other drawings. Specifically, the soundproof room 41*b* is composed of walls 44*a*, 45*a*, 46*a*, 47*a*, a ceiling 48*a*, and a floor 49*a*. The sound absorber 11*b* includes a top face, a bottom face, a front face 19*b* composed of a first side face 14*b*, and a back face 20*b* composed of a second side face 15*b* and a third side face 16*b*. The second side face 15*b* and third side face 16*b* are flat, but the first side face 14*b* has a curved surface. In this embodiment, the first side face 14*b* is shaped like an arc in cross section as shown in FIG. 17. More specifically, the first side face 14*b* is in the shape of a concave arc toward the inside of the sound absorber 11*b*. Even such a shaped sound absorber 11*b* can have a varying length in the thickness direction and thereby can more properly absorb sound. Alternatively, the first side face 14*b* can be shaped into a convex arc toward the outside of the sound absorber 11*b*. Furthermore, the first side face 14*b* can be composed of a plurality of curves.

Figure 18:
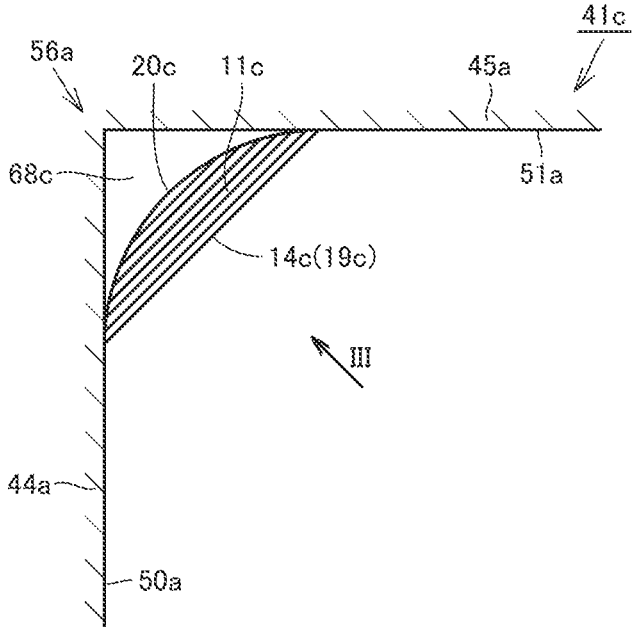
FIG. 18 is a cross-sectional view of a soundproof room according to yet another embodiment of the invention.

Yet another embodiment shown below is also acceptable. FIG. 18 is a cross-sectional view of a soundproof room 41*c* according to the embodiment of the present invention. Referring to FIG. 18, the soundproof room 41*c* of this embodiment of the invention includes a sound absorber 11*c*. The structure of walls and other components making up the soundproof room 41*c* is the same as that shown in FIG. 10 or other drawings. The sound absorber 11*c* includes a top face, a bottom face, a front face 19*c* composed of a first side face 14*c*, and a back face 20*c*. The first side face 14*c* is flat, but the back face 20*c* has a curved surface. In other words, the back face 20*c* is shaped into an arc in cross section as shown in FIG. 18. Specifically, the back face 20*c* is in the shape of a convex arc toward the outside of the sound absorber 11*b*. The sound absorber 11*c* in this shape can more properly absorb sound in the room. This shape creates a clearance 68*c* between the back face 20*c* and wall surfaces 50*a*, 51*a*, and the back face 20*c* is not exposed in the soundproof room 41*a*, but is surrounded by the walls 44*a*, 45*a*. Therefore, the presence of the clearance 68*c* does not particularly affect the reverberation. Alternatively, the back face 20*c* can be shaped into a convex arc toward the inside of the sound absorber 11*b*. Furthermore, the back face 20*c* can be composed of a plurality of curves.

Figure 19:
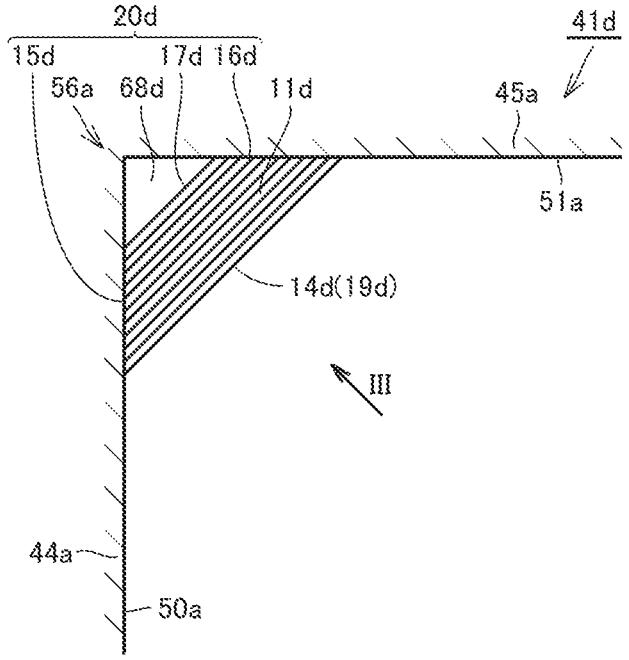
FIG. 19 is a cross-sectional view of a soundproof room according to yet another embodiment of the invention.

The sound absorber can be also configured as indicated below. FIG. 19 is a cross-sectional view of a soundproof room 41*d* according to yet another embodiment of the present invention. Referring to FIG. 19, the soundproof room 41*d* of this embodiment of the invention includes a sound absorber 11*d*. The structure of walls and other components making up the soundproof room 41*d* is the same as that shown in FIG. 10 and some other drawings. The sound absorber 11*d* includes a top face, a bottom face, a front face 19*d* composed of a first side face 14*d*, and a back face 20*d* composed of a second side face 15*d*, a third side face 16*d*, and a fourth side face 17*d*. The first side face 14*d*, second side face 15*d*, third side face 16*d* are all flat. The fourth side face 17*d* is also flat and is in parallel with the first side face 14*d* in cross section shown in FIG. 19. This shape creates a triangular clearance 68*d* between the wall surfaces 50*a*, 51*a* and the fourth side face 17*d* as viewed from the ceiling 48*a*. This configuration is also acceptable. Because the back face 20*d* is also surrounded by the walls 44*a* and 45*a* as with the case of the above embodiment, the clearance 68*d* does not particularly affect the reverberation. The fourth side face 17*d* of course can be shaped into an arc, and also does not need to be in parallel with the first side face 14*d*. Alternatively, the fourth side face 17*d* can be composed of a plurality of inclined flat surfaces.

Although the sound absorber 11*a* in the above-described embodiment is installed at the corner portion 56*a* of the soundproof room 41*a*, the present invention is not limited thereto, and therefore the sound absorber 11*a* can be installed at other parts of the soundproof room 41*a*, for example, in the vicinity of the corner portion 56*a*. This is also applied to the other sound absorbers in the other embodiments.

Figure 20:
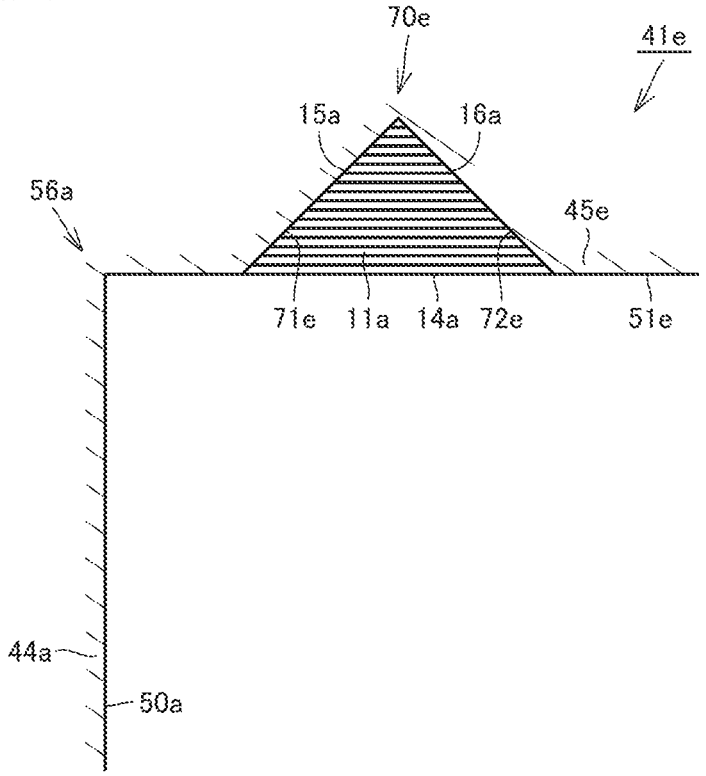
FIG. 20 is a cross-sectional view of a soundproof room according to yet another embodiment of the invention.

FIG. 20 is a cross-sectional view of a soundproof room 41*e* according to yet another embodiment of the present invention. FIG. 20 shows an area in the vicinity of the area XVI shown in FIG. 11. Referring to FIG. 20, the soundproof room 41*e* of this embodiment of the invention includes a sound absorber 11*a* having the configuration shown in FIG. 1 and some other drawings. A wall 45*e*, which is one of the components making up the soundproof room 41*e*, includes a recessed portion 70*e* that is recessed from a flat wall surface 51*e* toward the outside of the soundproof room 41*e*. The recessed portion 70*e* is composed of two wall surfaces 71*e*, 72*e*. Each of the wall surfaces 71*e*, 72*e* is formed so as to extend straight at an angle with respect to the wall surface 51*e*. The recessed portion 70*e* formed with the wall surfaces 71*e*, 72*e* has a shape into which the sound absorber 11*a* fits. Specifically, the wall surface 71*e* is shaped so as to fit with the second side face 15*a*, while the wall surface 72*e* is shaped so as to fit with the third side face 16*a*. The amount by which the recessed portion 70*e* is recessed with respect to the wall surface 51*e* is equivalent to the thickness of the sound absorber 11*a*.

In this embodiment, the second side face 15*a* is abutted against the wall surface 71*e* and the third side face 16*a* is abutted against the wall surface 72*e* to house the sound absorber 11*a* in the recessed portion 70*e*. The soundproof room 41*e* can be configured in this manner to have the sound absorber 11*a* installed therein. According to the configuration, the sound absorber 11*a* does not stick out from the wall surface 51*e* in the soundproof room 41*e*. The elimination of the sticking part of the sound absorber 11*a* from the soundproof room 41*e* allows effective use of free space in the soundproof room 41*e*.

Figure 21:
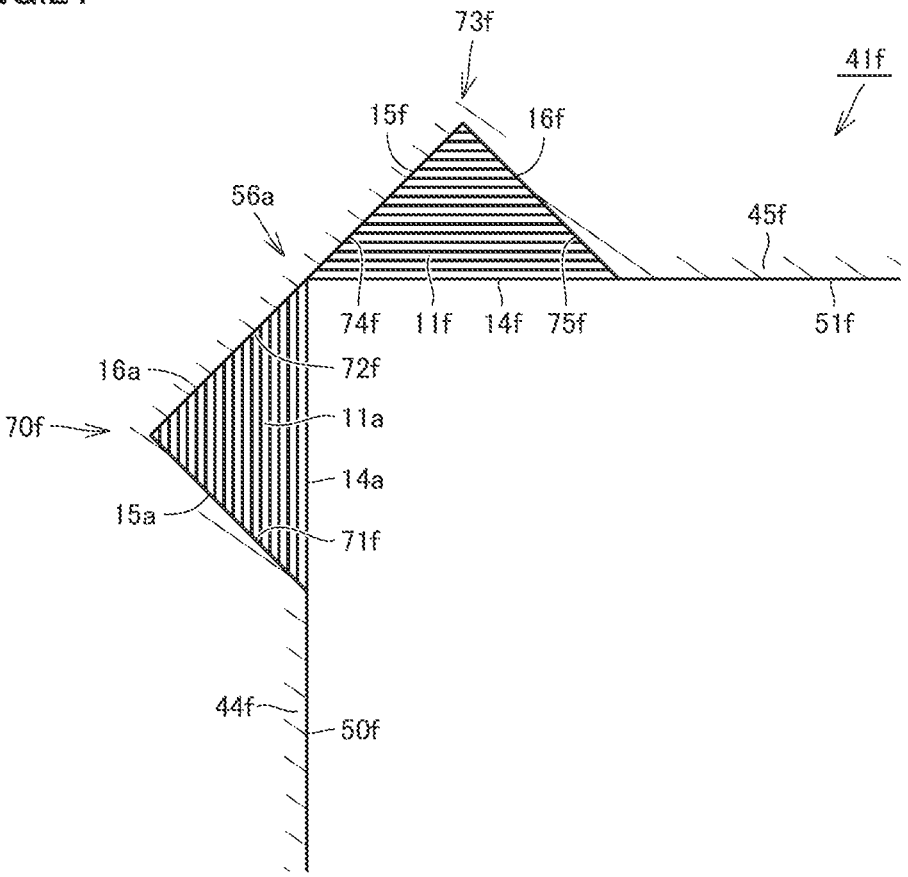
FIG. 21 is a cross-sectional view of a soundproof room according to yet another embodiment of the invention.

The sound absorber and soundproof room can be also configured as indicated below. FIG. 21 is a cross-sectional view of a soundproof room 41*f* according to yet another embodiment of the present invention. FIG. 21 shows an equivalent area to the area XVI in FIG. 11. Referring to FIG. 21, the soundproof room 41*f* of this embodiment of the invention includes a sound absorber 11*a* having the configuration shown in FIG. 1 and some other drawings and a sound absorber 11*f* having the same configuration as that of the sound absorber 11*a*. In short, the soundproof room 41*f* includes two sound absorbers 11*a* and 11*f*. A wall 45*f*, which is one of the components making up the soundproof room 41*f*, includes a first recessed portion 70*f* that is recessed from a flat wall surface 50*f* toward the outside of the soundproof room 41*f*. The first recessed portion 70*f* is composed of two wall surfaces 71*f*, 72*f*. Each of the wall surfaces 71*e*, 72*e* is formed so as to extend straight at an angle with respect to the wall surface 50*f*. The first recessed portion 70*f* formed with the wall surfaces 71*f*, 72*f* has a shape into which the first sound absorber 11*a* fits. A wall 45*f*, which is one of the components making up the soundproof room 41*f*, includes a second recessed portion 73*f* that is recessed from a flat wall surface 51*f* toward the outside of the soundproof room 41*f*. The second recessed portion 73*f* is composed of two wall surfaces 74*f*, 75*f*. Each of the wall surfaces 74*f*, 75*f* is formed so as to extend straight at an angle with respect to the wall surface 51*f*. The second recessed portion 73*f* formed with the wall surfaces 74*f*, 75*f* has a shape into which the second sound absorber 11*f* fits. The wall surface 72*f* of the first recessed portion 70*f* and the wall surface 74*f* of the second recessed portion 73*f* are flatly contiguous with each other in the area of the corner portion 56*a*.

In this embodiment, the second side face 15*a* is abutted against the wall surface 71*f* and the third side face 16*a* is abutted against the wall surface 72*f* to house the first sound absorber 11*a* in the first recessed portion 70*f*. In addition, the second side face 15*f* is abutted against the wall surface 74*f* and the third side face 16*f* is abutted against the wall surface 75*f* to house the second sound absorber 11*f* in the second recessed portion 73*f*. The soundproof room 41*f* is configured in this manner to have the first sound absorber 11*a* and second sound absorber 11*f* installed therein. According to the configuration, the two sound absorbers, that is, the first sound absorber 11*a* and second sound absorber 11*f* do not stick out from the wall surfaces 50*f* and 51*f*, respectively, of the soundproof room 41*f*. The elimination of the two sticking parts of the sound absorbers 11*a*, 11*f* from the soundproof room 41*f* allows effective use of free space in the soundproof room 41*f*.

Figure 22:
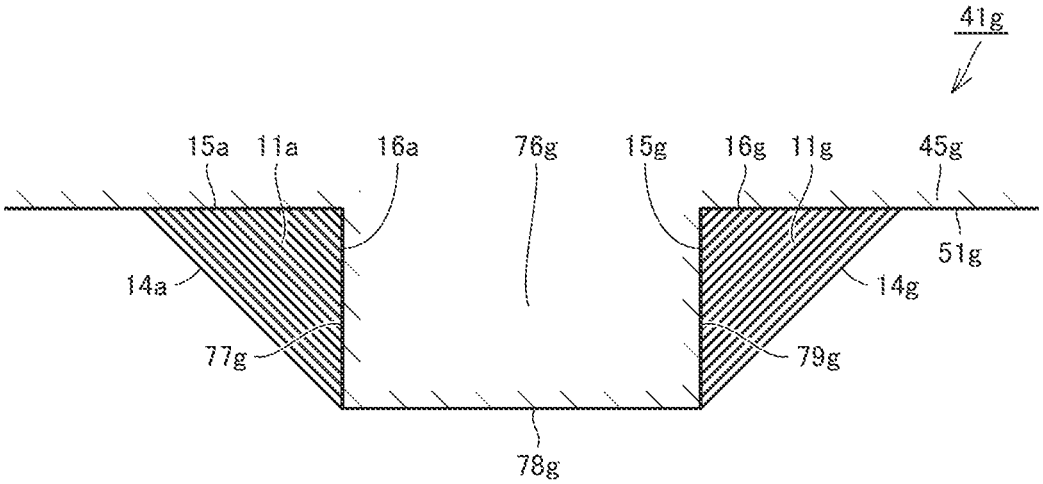
FIG. 22 is a cross-sectional view of a soundproof room according to yet another embodiment of the invention.

The sound absorber and soundproof room can be also configured as indicated below. FIG. 22 is a cross-sectional view of a soundproof room 41*g* according to yet another embodiment of the present invention. Referring to FIG. 22, the soundproof room 41*g* of this embodiment of the invention includes a sound absorber 11*a* having the configuration shown in FIG. 1 and some other drawings, and a sound absorber 11*g* having the same configuration as that of the sound absorber 11*a*. A wall 45*g*, which is one of the components making up the soundproof room 41*g*, includes a projecting portion 76*g* that projects from a flat wall surface 51*g* toward the inside of the soundproof room 41*g*. This projecting portion 76*g* is composed of three wall surfaces 77*g*, 78*g*, 79*g*. The wall surface 78*g* extends straight in parallel with the wall surface 51*g*. The wall surface 77*g* and wall surface 79*g* extend straight in the direction perpendicular to the wall surface 51*g* toward the inside of the soundproof room 41*g*. When viewed in cross section, the projecting portion 76*g* has simply a rectangular shape projecting with respect to the wall surface 51*g*. The amount by which the projecting portion 76*g* projects from the wall surface 51*g* corresponds to either of the length of the third side face 16*a* of the first sound absorber 11*a* and the length of the second side face 15*g* of the second sound absorber 11*g*. The wall surfaces 77*g*, 79*g* are shaped so as to fit with the third side face 16*a* of the first sound absorber 11*a* and the second side face 15*g* of the second sound absorber 11*g*, respectively.

In this embodiment, the second side face 15*a* is abutted against the wall surface 51*g* and the third side face 16*a* is abutted against the wall surface 77*g* to install the first sound absorber 11*a*. In addition, the second side face 15*g* is abutted against the wall surface 79*g* and the third side face 16*a* is abutted against the wall surface 51*g* to install the second sound absorber 11*g*. The soundproof room 41*g* is configured in this manner to have the two sound absorbers 11*a*, 11*g* installed therein. According to the configuration, in the soundproof room 41*g* having the projecting portion 76*g* projecting inwardly and two sound absorbers 11*a*, 11*g*, the two sound absorbers 11*a*, 11*g* can be placed in the soundproof room 41*g* by taking advantage of corners formed with the projecting portion 76*g* and the wall 45*g*, thereby allowing effective use of free space in the soundproof room 41*g*.

Figure 23:
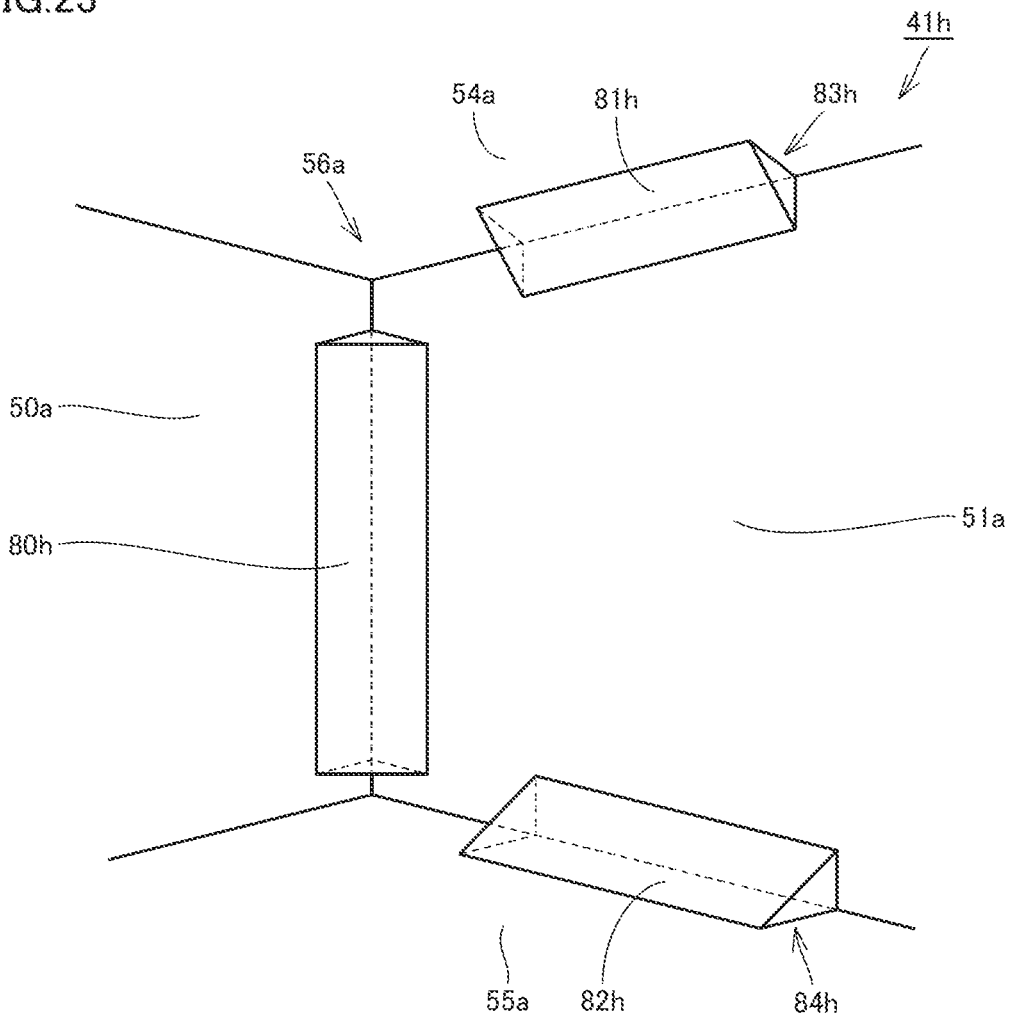
FIG. 23 is a schematic perspective view of a soundproof room according to yet another embodiment of the invention.

The sound absorber and soundproof room can be also configured as indicated below. FIG. 23 is a schematic perspective view of a soundproof room 41*h* according to yet another embodiment of the present invention. FIG. 23 shows an area corresponding to the area in FIG. 10. Referring to FIG. 23, the soundproof room 41*h* of this embodiment of the invention includes three sound absorbers 80*h*, 81*h*, 82*h*. These three sound absorbers 80*h* to 82*h* have the same fundamental functionality as that of the sound absorber 11*a* shown in FIG. 1 and some other drawings, but are different in dimension. Specifically, the length of the sound absorbers 80*h* to 82*h* in the height direction is set to be somewhat short in comparison with the sound absorber 11*a* in FIG. 1. In this embodiment, the first sound absorber 80*h* is installed in a corner portion 56*a* between the wall surfaces 50*a*, 51*a* of the adjacent walls, which make up the soundproof room 41*h*. The installed first sound absorber 80*h* extends vertically along its length, or in the direction from the ceiling surface 54*a* to the floor surface 55*a*. In addition, the second sound absorber 81*h* is installed in a corner portion 83*h* between the wall surface 51*a* of a wall and the ceiling surface 54*a* of the ceiling, the wall and ceiling making up the soundproof room 41*h*. The installed second sound absorber 81*h* extends horizontally along its length. Furthermore, the third sound absorber 82*h* is installed in a corner portion 84*h* between the wall surface 51*a* of the wall and the floor surface 55*a* of the floor, the wall and floor making up the soundproof room 41*h*. The installed third sound absorber 82*h* extends horizontally along its length. The sound absorbers 80*h*, 81*h*, 82*h* can be configured in this manner.

The soundproof room according to the present invention can include an exposed area adjusting mechanism that adjusts the exposed area of the surface of the sound absorber exposed in the room.

Figure 24:
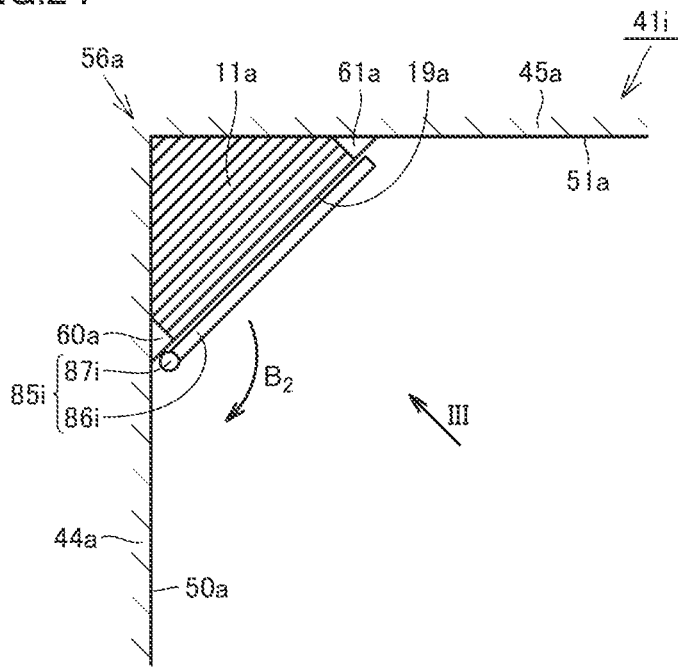
FIG. 24 is a cross-sectional view of a soundproof room according to yet another embodiment of the invention.

FIG. 24 is a cross-sectional view of a soundproof room 41*i* according to yet another embodiment of the present invention. Referring to FIG. 24, the soundproof room 41*i* of this embodiment of the invention includes a sound absorber 11*a* having the configuration shown in FIG. 1 and some other drawings. The sound absorber 11*a* is installed with its front face 19*a* exposed in the soundproof room 41*i*.

Figure 25:
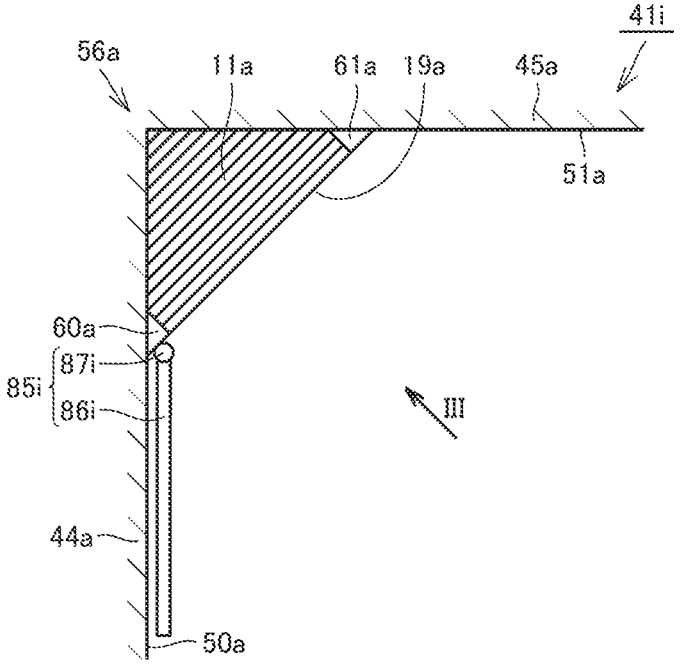
FIG. 25 is a cross-sectional view of a soundproof room according to yet another embodiment of the invention.

Attached on a wall surface 50*a* of the soundproof room 41*i* is a mounting member 60*a* that is used to hold a door 85*i* to adjust the exposed area of the front face 19*a* of the sound absorber 11*a*. The door 85*i* includes a flat plate member 86*i* and a support member 87*i* that rotatably supports the plate member 86*i* within a predetermined angle range. The shape and area of the plate member 86*i* are set to be large enough to cover the front face 19*a* of the sound absorber 11*a* when the door 85*i* is in a so-called closed state. Specifically, the plate member 86*i* has a predetermined thickness and is slightly larger than the first side face 14*a* as viewed from the front face 19*a*. FIG. 24 indicates the door 85*i* in a closed state, while FIG. 25 indicates the door 85*i* in an open state. As appreciated from the drawings, the door 85*i* can be opened and closed by turning the plate member 86*i* about the support member 87*i*, serving as a rotational center axis, in the direction indicated by Arrow $B_2$ in FIG. 24 and the reverse direction.

The door 85*i* configured as above enables adjustment of the exposed area of the front face 19*a*, which serves as a sound absorbing face of the sound absorber 11*a* in the soundproof room 41*i*. Thus, the degree at which the sound absorber 11*a* absorbs sound can be changed, and accordingly the reverberation time in the soundproof room 41*i* can be adjusted. Therefore, the soundproof room 41*i* can readily provide more appropriate reverberation, for example, to people who play music in the soundproof room 41*i*. This door 85*i* can be separated into a plurality of door segments in the height direction of the front face 19*a* to use the door segments as doors 85*i*. This configuration allows a door 85*i* located at a height to be opened and a door 85*i* located at another height to be closed. Of course, the reverberation can be adjusted by adjusting the open/close angle of the plate members 86*i*.

Figure 26:
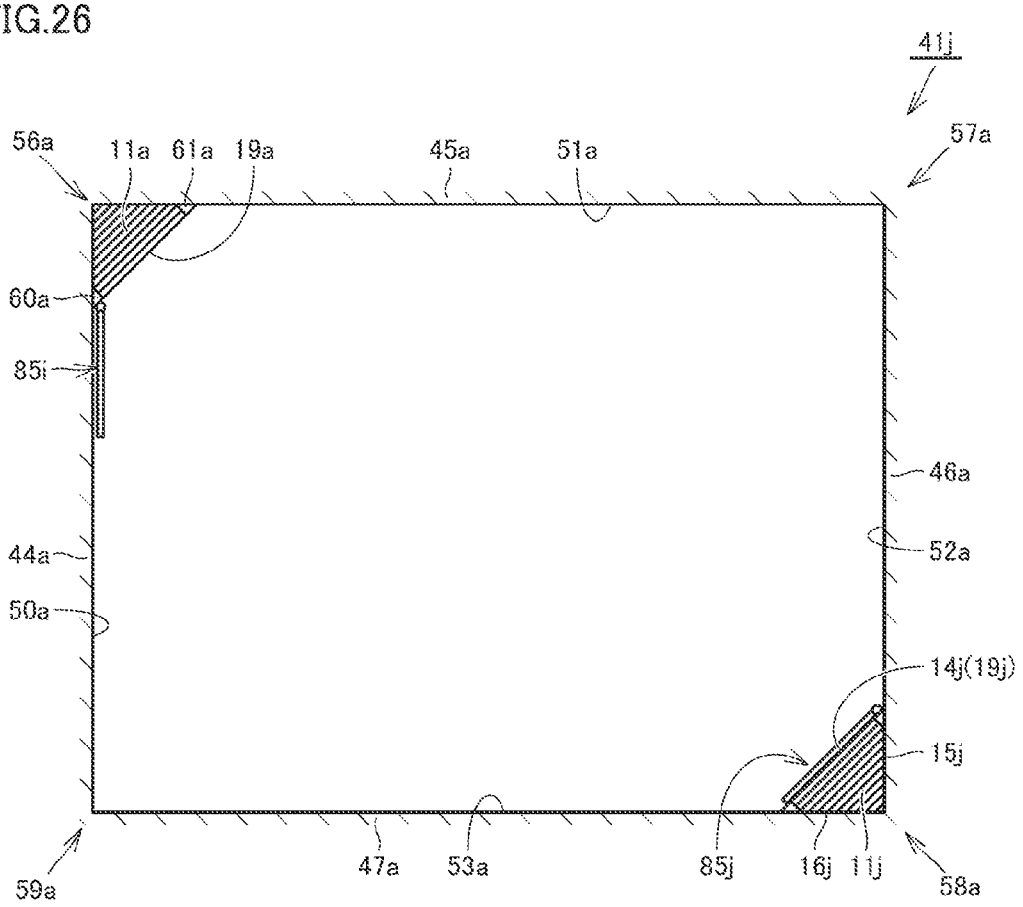
FIG. 26 is a schematic cross-sectional view of a soundproof room according to yet another embodiment of the invention.

The sound absorber and soundproof room can be also configured as indicated below. FIG. 26 is a schematic cross-sectional view showing a soundproof room according to yet another embodiment of the present invention. FIG. 26 shows the soundproof room viewed from the ceiling, and corresponds to the view of FIG. 11. Referring to FIG. 26, a soundproof room 41*j* of this embodiment of the invention includes two sound absorbers 11*a*, 11*j* both having the configuration shown in FIG. 1 and some other drawings. The soundproof room 41*j* is composed of four walls 44*a*, 45*a*, 46*a*, 47*a*, a ceiling, and a floor, as with the case of FIG. 11. The walls 44*a*, 45*a*, 46*a*, 47*a*, ceiling, and floor have flat wall surfaces 50*a*, 51*a*, 52*a*, 53*a*, a flat ceiling surface, and a flat floor surface, respectively, on the side of the interior space.

As with the case shown in FIG. 11, the first sound absorber 11*a* is installed in a corner portion 56*a* between the wall 44*a* and wall 45*a*. The second sound absorber 11*j* is installed in a corner portion 58*a* between the wall 46*a* and wall 47*a*. This second sound absorber 11*j* is also placed with a first side face 14*j*, serving as a front face 19*j*, exposed in the soundproof room 41*j* and with a second side face 15*j* and a third side face 16*j*, serving as a back face, covered with the wall 46*a* and wall 47*a*, respectively. In this embodiment, the first sound absorber 11*a* is placed so-called diagonally opposite to the second sound absorber 11*j*. In addition, the soundproof room 41*j* includes a door 85*i* that adjusts the exposed area of the front face 19*a* of the first sound absorber 11*a* and a door 85*j* that adjusts the exposed area of the front face 19*j* of the second sound absorber 11*j*. The soundproof room 41*j* configured as above is acceptable. According to the configuration, the soundproof room 41*j* equipped with the two sound absorbers 11*a*, 11*j* can provide more favorable reverberation by changing the opening/closing state of the doors 85*i*, 85*j*. In FIG. 26, the door 85*i* of the first sound absorber 11*a* is open, while the door 85*j* of the second sound absorber 11*j* is closed.

Figure 27:
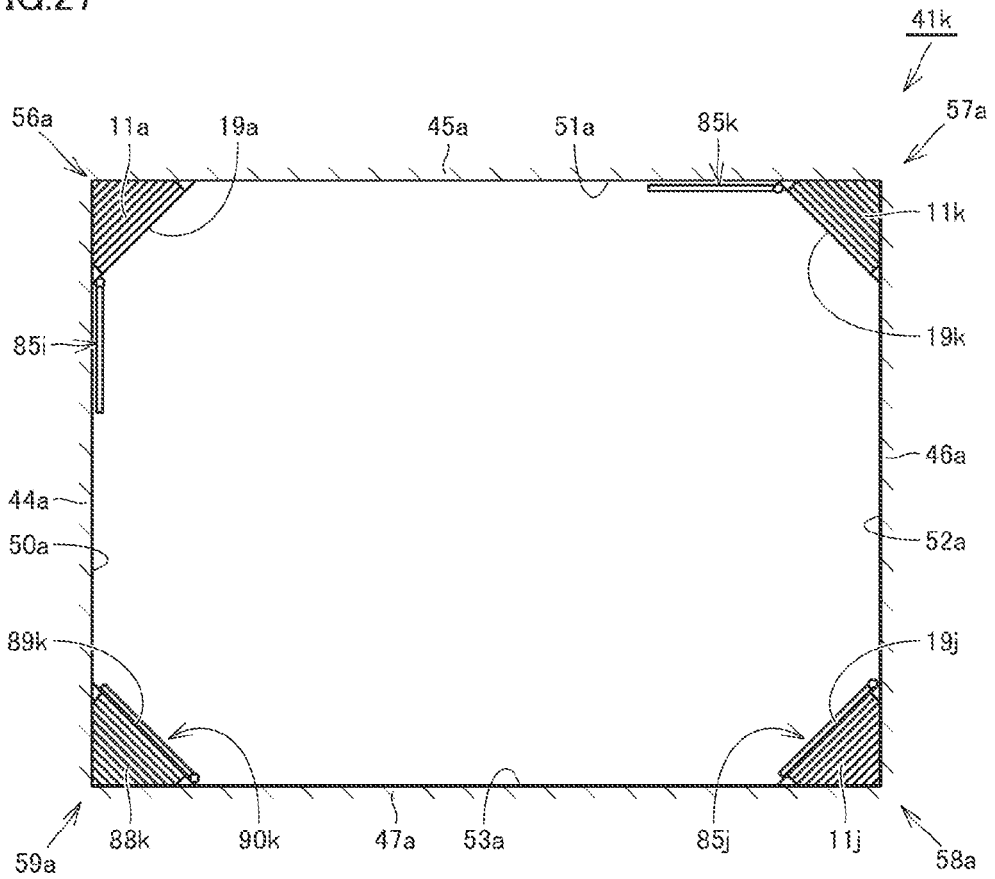
FIG. 27 is a schematic cross-sectional view of a soundproof room according to yet another embodiment of the invention.

The sound absorber and soundproof room can be also configured as indicated below. FIG. 27 is a schematic cross-sectional view of a soundproof room according to yet another embodiment of the present invention. FIG. 27 shows the soundproof room viewed from the ceiling, and corresponds to the views of FIGS. 11 and 26. Referring to FIG. 27, a soundproof room 41*k* of this embodiment of the invention includes four sound absorbers 11*a*, 11*j*, 11*k*, 88*k* having the configuration shown in FIG. 1 and some other drawings. As with the case shown in FIGS. 11 and 26, the soundproof room 41*k* is composed of four walls 44*a*, 45*a*, 46*a*, 47*a*, a ceiling, and a floor. The walls 44*a*, 45*a*, 46*a*, 47*a*, ceiling, and floor have flat wall surfaces 50*a*, 51*a*, 52*a*, 53*a*, a flat ceiling surface, and a flat floor surface, respectively, on the side of the interior space.

As with the case shown in FIG. 11, the first sound absorber 11*a* is installed in a corner portion 56*a* between the wall 44*a* and wall 45*a*. As with the case shown in FIG. 26, the second sound absorber 11*j* is installed in a corner portion 58*a* between the wall 46*a* and wall 47*a*. The third sound absorber 11*k* is installed in a corner portion 57*a* between the wall 45*a* and wall 46*a*. The fourth sound absorber 88*k* is installed in a corner portion 59*a* between the wall 44*a* and wall 47*a*. In this embodiment, the first sound absorber 11*a*, second sound absorber 11*j*, third sound absorber 11*k*, and fourth sound absorber 88*k* are placed simply in four corners of the rectangular soundproof room 41*k* as viewed from the ceiling.

Also, the soundproof room 41*k* includes a door 85*i* that adjusts the exposed area of the front face 19*a* of the first sound absorber 11*a*, a door 85*j* that adjusts the exposed area of the front face 19*j* of the second sound absorber 11*j*, a door 85*k* that adjusts the exposed area of the front face 19*k* of the third sound absorber 11*k*, and a door 90*k* that adjusts the exposed area of the front face 89*k* of the fourth sound absorber 88*k*. The soundproof room 41*k* can be configured as above. According to the configuration, the soundproof room 41*k* equipped with the four sound absorbers 11*a*, 11*j*, 11*k*, 88*k* can provide more favorable reverberation by changing the opening/closing state of the doors 85*i*, 85*j*, 85*k*, 90*k*.

Figure 28:
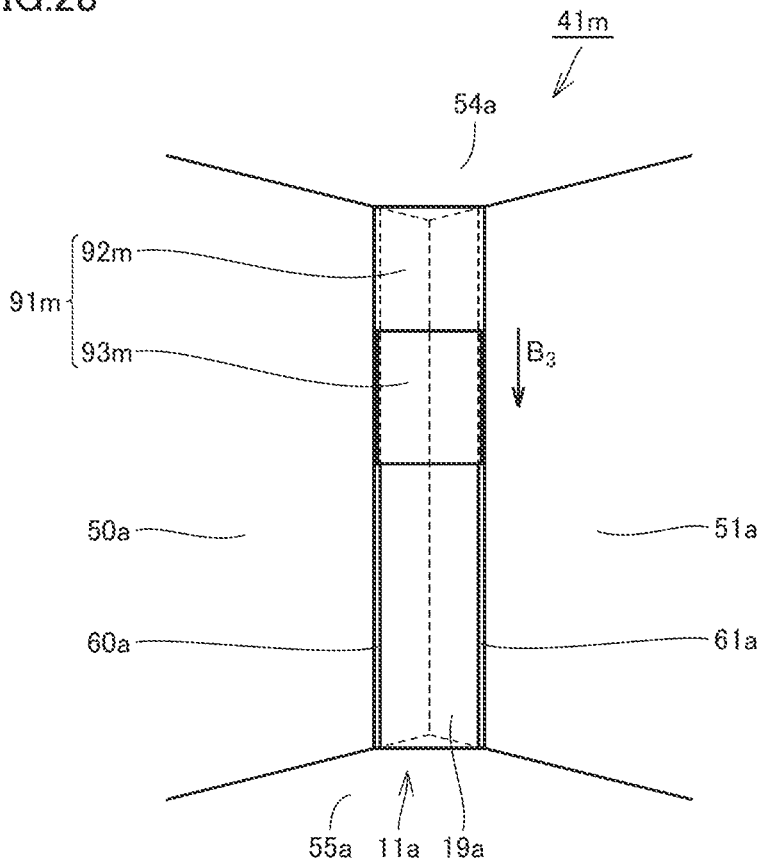
FIG. 28 is a schematic perspective view of a soundproof room according to yet another embodiment of the invention.

The sound absorber and soundproof room can be also configured as indicated below. FIG. 28 is a schematic perspective view of a soundproof room 41*m* according to yet another embodiment of the present invention. FIG. 28 shows an area corresponding to the area in FIG. 10. Referring to FIG. 28, the soundproof room 41*m* of this embodiment of the invention includes a sound absorber 11*a* having the configuration shown in FIG. 1 and some other drawings. The sound absorber 11*a* is installed with its front face 19*a*, serving as a sound absorbing face, exposed in the soundproof room 41*m*.

Attached on wall surfaces 50*a*, 51*a* of the soundproof room 41*m* are mounting members 60*a*, 61*a*, respectively, to which a door 91*m* is attached to adjust the exposed area of the front face 19*a* of the sound absorber 11*a*. The door 91*m* is like a shutter including a plurality of flat plate members 92*m*, 93*m*. Specifically, the plate members 92*m*, 93*m* that are movable in the vertical direction, as indicated by Arrow $B_3$ in FIG. 28 or the reverse direction, are attached to the mounting members 60*a*, 61*a*. Moving the plate members

92*m*, 93*m* vertically can adjust the exposed area of the front face 19*a* of the sound absorber 11*a* in the soundproof room 41*m*.

Figure 29:
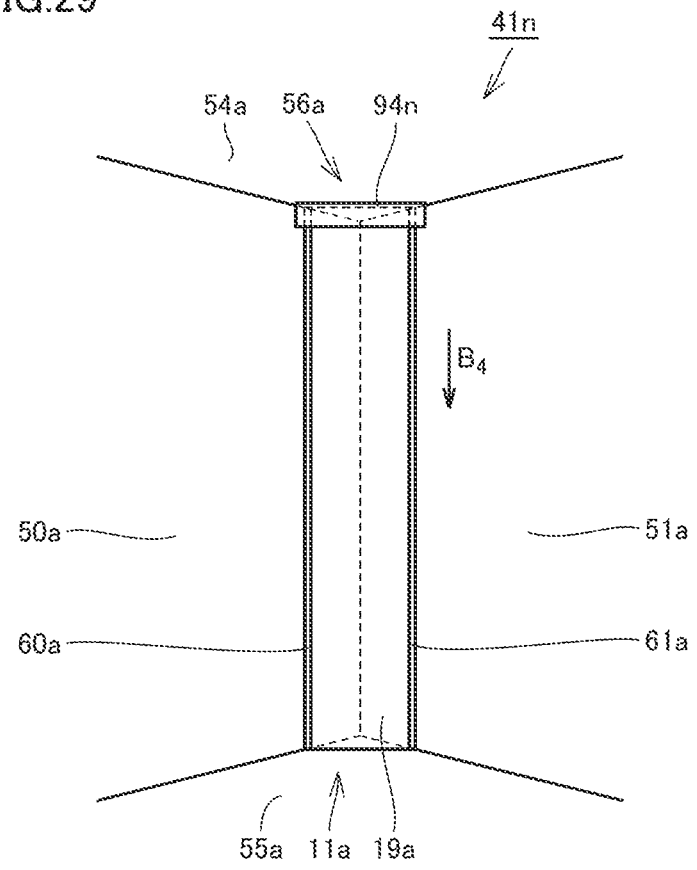
FIG. 29 is a schematic perspective view of a soundproof room according to yet another embodiment of the invention.

The sound absorber and soundproof room can be also configured as indicated below. FIG. 29 is a schematic perspective view of a soundproof room 41*n* according to yet another embodiment of the present invention. FIG. 29 shows an area corresponding to the area in FIG. 10. Referring to FIG. 29, the soundproof room 41*n* of this embodiment of the invention includes a sound absorber 11*a* having the configuration shown in FIG. 1 and some other drawings. The sound absorber 11*a* is installed with its front face 19*a* exposed in the soundproof room 41*n*.

Figure 30:
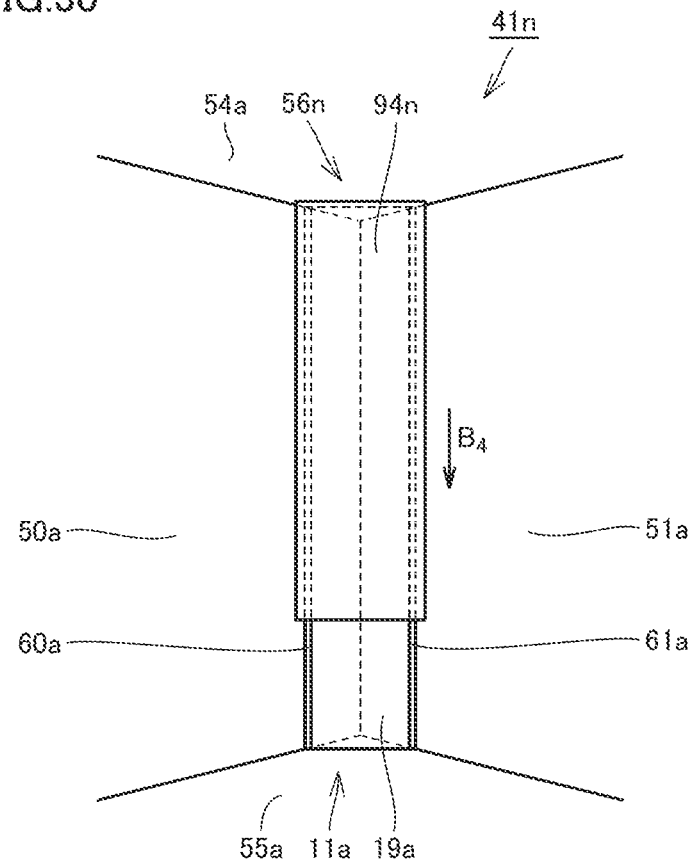
FIG. 30 is a schematic perspective view of a soundproof room according to yet another embodiment of the invention.

Attached on wall surfaces 50*a*, 51*a* of the soundproof room 41*n* are mounting members 60*a*, 61*a*, respectively, to which a screen member 94*n* is attached to adjust the exposed area of the front face 19*a* of the sound absorber 11*a*. The screen member 94*n* is attached to the mounting members 60*a*, 61*a*. The screen member 94*n* is, for example, a rolled-up cloth-like member, and is extensible in the longitudinal direction of the sound absorber 11*a*, or in the vertical direction, as indicated by Arrow $B_4$ in FIG. 29, or the reverse direction. The screen member 94*n* can adjust the exposed area of the front face 19*a*, serving as a sound absorbing face, freely from the full open position to the full closed position. Specifically, the screen member 94*n* has a lower end. The screen member 94*n* can be pulled down and held at any position by stopping pulling the lower end to cover a part of the front face 19*a*, thereby adjusting the exposed area of the front face 19*a*. FIG. 30 shows the screen member 94*n* with the lower end stopped at a desired position.

Though it is not illustrated, the aforementioned exposed area adjusting mechanism can be implemented in different ways. For example, a rotational shaft is provided to a sound absorber 11*a* in FIG. 2, so as to extend on the corner 21*a* in the longitudinal direction, and this rotational shaft is attached to, for example, a corner portion 56*a* of the room 41*a* shown in FIG. 11. Turning the sound absorber 11*a* about the rotational shaft serving as the center of rotation makes it possible to expose some part of the front face 19*a* in the room 41*a* to adjust the exposed area, or to hide the front face 19*a*. To implement this, it is desirable to form a storage by recessing a part of a wall 44*a* to house the sound absorber 11*a*. Of course, the rotational shaft can be provided anywhere in the room 41*a*. Furthermore, the rotational shaft does not need to always extend in the longitudinal direction.

Alternatively, the sound absorber 11*a* can be configured in such a way as to be pulled out from a wall 44*a* like a drawer and to be housed in the wall 44*a*. According to the configuration, the sound absorber 11*a* is pulled out from a wall surface 50*a* of the wall 44*a* by a certain extent to expose the front face 19*a* in a room 41*a* so that the necessary exposed area required for a necessary degree of reverberation can be ensured. In this case and the aforementioned case of the rotational shaft, it may be preferable to provide a member functioning as a handle, a grip, etc. somewhere on the front face 19*a* or back face 20*a*.

In the above-described embodiments, the layer members are made of a nonwoven fabric; however, the present invention is not limited thereto, and the layer members may be made of a woven fabric or may be made of a paper-like material, for example.

Although the mounting members, doors attached to the mounting members, and screen member attached to the mounting members are attached to the soundproof room in the above-described embodiments, the sound absorber itself can be equipped with those. In other words, the sound absorber that absorbs sound in a room can be equipped with the exposed area adjusting mechanism for adjusting the exposed area of the sound absorbing face exposed in the room.

Although the embodiments of the present invention have been described with reference to the figures, the present invention is not limited to the illustrated embodiments. Various modifications and variations can be made to the above illustrated embodiments within the same scope as, or an equivalent scope to, the present invention.

INDUSTRIAL APPLICABILITY

The soundproof room according to the invention is effectively used to meet demands for more proper sound absorption.

REFERENCE SIGNS LIST

11*a*, 11*b*, 11*c*, 11*d*, 11*f*, 11*g*, 11*j*, 11*k*, 80*h*, 81*h*, 82*h*, 88*k*: sound absorber, 12*a*: top face, 13*a*: bottom face, 14*a*, 14*b*, 14*c*, 14*d*, 14*g*, 14*j*, 15*a*, 15*b*, 15*d*, 15*g*, 15*j*, 16*a*, 16*b*, 16*d*, 16*g*, 16*j*, 17*a*, 17*d*, 18*a*, 62*a*, 63*a*, 64*a*, 65*a*: side face, 19*a*, 19*b*, 19*c*, 19*d*, 19*j*, 19*k*, 89*k*: front face, 20*a*, 20*b*, 20*c*, 20*d*: back face, 21*a*, 22*a*, 23*a*: corner, 24*a*, 25*a*, 26*a*, 27*a*, 28*a*, 66*a*, 66*b*, 66*c*: line, 29*a*, 29*b*, 29*c*, 29*d*, 29*e*: end, 30*a*, 30*b*, 67*a*, 67*b*, 67*c*, 67*d*: region, 31*a*, 31*b*, 31*c*: segment, 32*a*, 32*b*: dot, 33*a*, 33*b*, 33*c*, 33*d*, 33*e*, 33*f*, 33*g*, 33*h*, 33*i*, 33*j*, 39*a*, 39*b*, 39*c*: layer member, 34*a*: layered structure, 35*a*: fibers, 36*a*, 36*b*: end face, 37*a*, 37*b*: face, 38*a*: semifinished product, 40*a*: section, 41*a*, 41*b*, 41*c*, 41*d*, 41*e*, 41*f*, 41*g*, 41*h*, 41*i*, 41*j*, 41*k*, 41*m*, 41*n*: soundproof room, 43*a*: interior space, 44*a*, 44*f*, 45*a*, 45*e*, 45*f*, 45*g*, 46*a*, 47*a*: wall, 48*a*: ceiling, 49*a*: floor, 50*a*, 50*f*, 51*a*, 51*e*, 51*f*, 51*g*, 52*a*, 53*a*, 71*e*, 71*f*, 72*e*, 72*f*, 74*f*, 75*f*, 77*g*, 78*g*, 79*g*: wall surface, 54*a*: ceiling surface, 55*a*: floor surface, 56*a*, 57*a*, 58*a*, 59*a*, 83*h*, 84*h*: corner portion, 60*a*, 61*a*: mounting member, 68*c*, 68*d*: clearance, 70*e*, 70*f*, 73*f*: recessed portion, 76*g*: projecting portion, 85*i*, 85*j*, 85*k*, 90*k*, 91*m*: door, 86*i*, 92*m*, 93*m*: plate member, 87*i*: support member, 94*n*: screen member.

The invention claimed is:

1. A soundproof room, comprising:

walls defining an interior space; and a sound absorber, the sound absorber being substantially triangular in cross-section, and having a first side face, a second side face adjacent the first side face, a third side face adjacent to the first side face and adjacent to the second side face, a top face, and a bottom face opposite the top face, wherein the sound absorber comprises:

a first layer member having a sound absorbing surface and a rear surface opposite the sound absorbing surface, wherein the sound absorbing surface faces the interior space, and the first side face comprises the sound absorbing surface; and a plurality of second layer members stacked on the rear surface of the first layer member in a depth direction away from the interior space, wherein the first layer member and the second layer members of the plurality of second layer members each have a corresponding thickness such that the sound absorber is configured to have a gradually increasing rate of sound absorption in a first frequency range having a center frequency of about 125 Hz, and a substantially constant rate of sound absorption over a second frequency range having a center frequency of about 500 Hz, each second layer member of the plurality of second layer members has a corresponding surface area, a first surface area of one second layer member of the plurality of second layer members is greater than a second surface area of a different second layer member of the plurality of second layer members, and the second layer member having the first surface area is closer to the first layer member than the second layer member having the second surface area, the first layer member has a first density, the second layer members of the plurality of second layer members have a second density, the first density is greater than the second density, and each of the first layer member and each second layer member of the plurality of second layer members comprise a same material.

2. The soundproof room according to claim 1, wherein the sound absorber comprises:

a first segment having a first thickness extending from the sound absorbing surface in the depth direction, the first thickness being at least 23 cm; and a second segment having a second thickness extending from the sound absorbing surface in the depth direction, the second thickness being less than 23 cm.

3. The soundproof room according to claim 1, wherein the sound absorber comprises:

a maximum depth region having a first thickness extending from the sound absorbing surface in the depth direction, the first thickness being a greatest thickness in the depth direction; and a depth increasing region having a varying thickness that increases while approaching the maximum depth region, the varying thickness extending from the sound absorbing surface in the depth direction, wherein the depth increasing region is adjacent to the maximum depth region.

4. The soundproof room according to claim 1, wherein the first layer member and each second layer member of the plurality of second layer members comprise an unwoven fabric.

5. The soundproof room of claim 1, wherein the surface area of the second layer members of the plurality of second layer members decreases as a distance away from the first layer member increases in the depth direction.

6. The soundproof room of claim 5, wherein the surface area of each second layer member of the plurality of second layer members is different.

7. The soundproof room of claim 1, wherein the surface area of each second layer member of the plurality of second layer members is different.

8. The soundproof room of claim 1, wherein the sound absorption is based on an amount of time a sound output to the interior space is reverberated.

9. A soundproof room, comprising:

walls defining an interior space; and a sound absorber, the sound absorber being substantially triangular in cross-section, and having a first side face, a second side face adjacent the first side face, a third side face adjacent to the first side face and adjacent to the second side face, a top face, and a bottom face opposite the top face, wherein the sound absorber comprises:

a first layer member having a sound absorbing surface and a rear surface opposite the sound absorbing surface, wherein the sound absorbing surface faces the interior space, the first side face comprises the sound absorbing surface, and the first layer member has a first density; and one or more second layer members stacked on the rear surface of the first layer member in a depth direction away from the interior space, wherein the one or more second layer members have a second density less than the first density, and each of the one or more second layer members comprises a same material as the first layer member, wherein the first layer member and the one or more second layer members each have a corresponding thickness such that the sound absorber is configured to have a variable rate of sound absorption in a first frequency range having a center frequency of about 125 Hz.

10. The soundproof room of claim 9, wherein the sound absorber is further configured have a substantially constant rate of sound absorption in a second frequency range having a center frequency of about 500 Hz.

11. The soundproof room of claim 10, wherein the sound absorber is further configured have a substantially constant rate of sound absorption in a third frequency range between the first frequency range and the second frequency range.

12. The soundproof room of claim 11, wherein the variable rate of sound absorption in the first frequency range gradually increases over the first frequency range to a sound absorption value associated with the third frequency range.

13. The soundproof room of claim 9, wherein each of the first layer member and the one or more second layer members comprises an unwoven material having corresponding fibers, and the fibers of the first layer member are intertwined with the fibers of one of the second layer members.

14. The soundproof room of claim 13, wherein the fibers of two of more second layer members are intertwined.

15. The soundproof room of claim 9, wherein the first layer member and the one or more second layer members comprise a woven material.

16. A soundproof room, comprising:

walls defining an interior space; and a sound absorber, the sound absorber being substantially triangular in cross-section, and having a first side face, a second side face adjacent the first side face, a third side face adjacent to the first side face and adjacent to the second side face, a top face, and a bottom face opposite the top face, wherein the sound absorber comprises:

a first layer member having a sound absorbing surface and a rear surface opposite the sound absorbing surface, wherein the sound absorbing surface faces the interior space, the first side face comprises the sound absorbing surface, and the first layer member has a first density; and one or more second layer members stacked on the rear surface of the first layer member in a depth direction away from the interior space, wherein the one or more second layer members have a second density less than the first density, and each of the one or more second layer members comprises a same material as the first layer member, wherein the first layer member and the one or more second layer members each have a corresponding thickness such that the sound absorber is configured to have a gradually increasing rate of sound absorption in a first frequency range having a first center frequency and a substantially constant rate of sound absorption over a second frequency range having a second center frequency greater than the first center frequency.

17. The soundproof room of claim 16, wherein the gradually increasing rate of sound absorption is parabolic.

18. The soundproof room of claim 16, wherein the first center frequency is 125 Hz and the second center frequency is 500 Hz.

19. The soundproof room of claim 16, wherein the sound absorption value is based on an amount of time a sound is reverberated in the interior space after being output.

20. The soundproof room of claim 16, wherein the first layer member and the one or more second layer members comprise a woven material.

* * * * *